US005968701A

United States Patent [19]

Onuma et al.

[11] Patent Number: 5,968,701

[45] Date of Patent: Oct. 19, 1999

[54] TONER AND IMAGE FORMING METHOD

[75] Inventors: Tsutomu Onuma, Yokohama; Hirohide Tanikawa; Masami Fujimoto, both of Suntoh-gun; Hiroyuki Fujikawa, Yokohama, all of Japan

[73] Assignee: Canon Kabushiki Kaisha, Tokyo, Japan

[21] Appl. No.: 09/219,751

[22] Filed: Dec. 23, 1998

[30] Foreign Application Priority Data

Dec. 25, 1997 [JP] Japan ..... 356562

[51] Int. Cl.[6] ..... G03G 9/097; G03G 13/20

[52] U.S. Cl. ..... 430/110; 430/111; 430/124

[58] Field of Search ..... 430/110, 111, 430/124

[56] References Cited

U.S. PATENT DOCUMENTS

| | | | |
|---|---|---|---|
| 4,913,991 | 4/1990 | Chiba et al. | 430/111 |
| 5,234,784 | 8/1993 | Aslam et al. | 430/124 |
| 5,254,526 | 10/1993 | Aslam et al. | 430/124 |
| 5,256,507 | 10/1993 | Aslam et al. | 430/111 |
| 5,258,526 | 11/1993 | Aslam et al. | 430/124 |
| 5,384,224 | 1/1995 | Tanikawa et al. | 430/110 |
| 5,637,433 | 6/1997 | Uchida et al. | 430/110 |
| 5,707,771 | 1/1998 | Matsunaga | 430/110 |
| 5,744,276 | 4/1998 | Ohno et al. | 430/110 |

*Primary Examiner*—Roland Martin
*Attorney, Agent, or Firm*—Fitzpatrick, Cella, Harper & Scinto

[57] ABSTRACT

A toner exhibiting good fixing performances even at a high process speed is formed of a binder resin, a wax and a colorant. The toner is especially characterized by visco-elastic properties including: (a) a storage modulus G' (160° C.) of $8.0\times10^2$–$1.2\times10^4$ Pa at 160° C., (b) a loss modulus G" (160° C.) of $4.0\times10^2$–$6.0\times10^3$ Pa at 160° C., (c) a loss tangent tanδ (160° C.)=G" (160° C.)/G' (160° C.) of 0.1–1.5 at 160° C., (d) a storage modulus G' (190° C.) of $6.0\times10^2$–$1.6\times10^4$ Pa at 190° C., (e) a loss modulus G" (190° C.) of $2.0\times10^2$–$4.0\times10^3$ Pa at 190° C., (f) a yloss tangent tanδ (190° C.)=G" (190° C.)/G' (190° C.) of 0.05–1.2 at 190° C., (g) G' (160° C.)/G' (190° C.)=0.5–2.0, and (h) tanδ (160° C.)>tanδ (190° C.).

55 Claims, 11 Drawing Sheets

51 : HEATING CYLINDER
52 : PADDLE
53 : VENT
54 : SUPPLY PORT
55 : EXTRUSION PORT
56 : FEED HOPPER (S)

(R)

(W)

(L)

L : PADDLE ENTIRE LENGTH
D : SCREW DIAMETER
$S_1$, $S_2$, $S_3$ : SCREW SECTION
$Ln_1$, $Ln_2$ : KNEADING SECTION
V : VENT

L : PADDLE ENTIRE LENGTH
D : SCREW DIAMETER
$S_1$, $S_2$, $S_3$ : SCREW SECTION
$Ln_1$, $Ln_2$ : KNEADING SECTION
V : VENT

L : PADDLE ENTIRE LENGTH
D : SCREW DIAMETER
$S_1$, $S_2$, $S_3$ : SCREW SECTION
$Ln_1$, $Ln_2$ : KNEADING SECTION
V : VENT

TONER AND IMAGE FORMING METHOD

FIELD OF THE INVENTION AND RELATED ART

The present invention relates to a toner for use in an image forming method, such as electrophotography, electrostatic recording, magnetic recording and toner jetting, and also an image forming method using the toner, particularly a toner adopted for heat fixation and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image. According to necessity, residual toner remaining on the photosensitive member without transfer is cleaned by various methods. The above steps are repeated for successive image formation.

In recent years, such an image forming method is adopted not only in copying machines for reproducing originals for office use but also in printers as output devices for computers and personal copiers for individuals.

For this reason, such image forming apparatus are required to be smaller and lighter in weight and exhibit higher speed and higher reliability. Accordingly, mechanical parts constituting the apparatus tends to be composed of simpler elements. As a result, the toner is on the contrary required to exhibit a higher performance, and a better image forming machine cannot be achieved without improvement in toner performances.

For example, as means for fixing a toner image onto a recording material, such as paper, various methods and apparatus have been developed, including those of the pressure-heat fixation scheme using a heating roller and of the heat fixation scheme wherein a recording material is pressed by a pressing member to a heating member via a film.

In the heat-fixation scheme using a heating roller or a film, a surface carrying a toner image of a recording material or fixation sheet is pressed against a surface comprising a material exhibiting a reliability to a toner to be passed in contact therewith, thereby fixing the toner image onto the fixation sheet. In this fixation scheme, as the heating roller or film surface and the toner image on the fixation sheet contact each other, a very good heat efficiency is attained for melt-attaching the toner image onto the fixation sheet to afford quick fixation, so that the scheme is very effective in electrophotographic image forming apparatus.

In the heat fixation scheme, however, in order to obviate a fixation failure caused by a lowering in temperature of a heat fixing member due to passage of fixation sheets and fixation in a low temperature environment, it is necessary to increase the heat capacity of the heat fixing member, thus requiring a large power supply. Accordingly, the realization of lower power consumption while retaining the fixability depends largely on improvement in toner performances, particularly an improvement in low-temperature fixability of the toner.

In the fixing step of, e.g., the pressure-heat fixation scheme, however, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be low in case of a slow fixing speed and set to be high in case of a fast fixing speed. This is because a constant heat quantity is supplied to the toner image for fixation thereof regardless of a difference in fixing speed.

The toner on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause a so-called high-temperature offset phenomenon in case of a high heating roller temperature, while a so-called low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, and the occurrence of a trace in the fixed image of a separating member for separating the fixation sheet from the fixing roller.

Particularly, in recent years, it has been required to reduce the length of a leading white marginal region on a recording sheet in order to provide a higher image reproducibility as a part of higher image qualities. However, as the leading while marginal region is reduced, the fixation sheet is liable to be wound about the fixing member. Accordingly, it has been desired to improve the toner for obviating the winding about the fixing member.

Accordingly, it has been awaited to develop a toner which exhibits a low melt viscosity and a good fixability even at low temperatures and is free from winding or offset in either of high speed—high pressure fixation and low speed—low pressure fixation.

Japanese Laid-Open Patent Application (JP-A) 59-214860, JP-A 1-128071, JP-A 1-147465, JP-A 1-303447, JP-A 4-202307 and JP-A 4-353866 have disclosed electrophotographic toners having specific rheological properties, which have not succeeded in realization of high degree of fixability and anti-offset property in combination, and also have left problems of the winding of the fixation sheet about the fixing roller and traces of a separation claw in the resultant images.

JP-A 3-63661, JP-A 3-63662, JP-A 3-63663, J-PA 3-118552 and JP-A 3-197669 have disclosed a toner composition containing a resin (A) having a residual carboxyl group formed by reaction of a copolymer of a styrene monomer, a (meth)acrylate monomer and a carboxyl group-containing vinyl monomer with a polyvalent metal compound, and describes that a toner of the composition exhibits good fixability and good anti-offset property over a wide fixation temperature range. However, a toner of the composition exhibits a relatively large difference in dynamic elasticity between low and high temperatures to cause locally different fixation performances between an upper portion and a lower portion of a toner layer subjected to fixation, whereby the resultant recording sheet is liable to be curled and wound about the fixing member. Thus, a room for improvement has been left.

JP-A 6-11890 and JP-A 6-222612 have disclosed a toner containing a binder resin composition formed by reacting a COOH group-containing vinyl resin (A) and a glycidyl compound (B) and describes that the toner is applicable to a high-speed machine and exhibits a good balance among fixability, anti-offset properties and anti-blocking property. However, the toner also exhibits a large difference in dynamic elasticity and requires a further improvement in obviating the winding of a recording sheet about the fixing member.

JP-A 4-199061 has disclosed a toner comprising at least a resin, a colorant and a metal-containing compound, and having specific visco-elastic properties at temperatures of 100–200° C. JP-A 7-82249 and Japanese Patent No. 2783671 disclose a toner comprising a resin and a metal salt or metal complex and having specific visco-elastic properties at temperatures of 120–200° C. However, these prior art references fail in disclosing visco-elastic properties at 160° C. and 190° C., and the toners disclosed therein fail to exhibit performances peculiarly satisfied by such visco-elastic properties at 160° C. and 190° C. as will be discussed hereinafter.

SUMMARY OF THE INVENTION

A generic object of the present invention is to provide a toner having solved the above-mentioned problems and capable of exhibiting better performances.

A more specific object of the present invention is to provide a toner excellent in fixability and anti-offset property at low temperatures.

Another object of the present invention is to provide a toner excellent in anti-offset property at high temperatures.

Another object of the present invention is to provide a toner free from winding about a fixing roller.

Another object of the present invention is to provide a toner free from resulting in traces of a separation claw in fixed toner images.

Another object of the present invention is to provide a toner free from fog in fixed images.

Another object of the present invention is to provide a toner free from causing image white-dropout due to soiling of a fixing roller.

Another object of the present invention is to provide a toner excellent in anti-blocking property.

Another object of the present invention is to provide a toner free from toner melt-sticking onto a photosensitive member.

A further object of the present invention is to provide an image forming method using a toner as described above.

According to the present invention, there is provided a toner comprising: at least a binder resin, a wax and a colorant, wherein the toner exhibits visco-elastic properties including:

(a) a storage modulus G' (160° C.) of $8.0\times10^2$– $1.2\times10^4$ Pa at 160° C., (b) a loss modulus G" (160° C.) of $4.0\times10^2$–$6.0\times10^3$ Pa at 160° C., (c) a loss tangent tanδ (160° C.)=G" (160° C.)/G' (160° C.) of 0.1–1.5 at 160° C., (d) a storage modulus G' (190° C.) of $6.0\times10^2$–$1.0\times10^4$ Pa at 190° C., (e) a loss modulus G" (190° C.) of $2.0\times10^2$–$4.0\times10^3$ Pa at 190° C., (f) a loss tangent tanδ (190° C.)=G" (190° C.)/G' (190° C.) of 0.05–1.2 at 190° C., (g) G' (160° C.)/G' (190° C.)=0.5–2.0, and (h) tanδ (160° C.)>tanδ (190° C.).

According to another aspect of the present invention, there is provided an image forming method, comprising:

(1) a developing step of developing an electrostatic latent image on an image bearing member with the above-mentioned toner to form a toner image thereon, (2) a transfer step of transferring the toner image formed on the image bearing member onto a recording material via or without via an intermediate transfer member, and (3) a fixing step of heat-fixing the toner image transferred to the recording material onto the recording material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
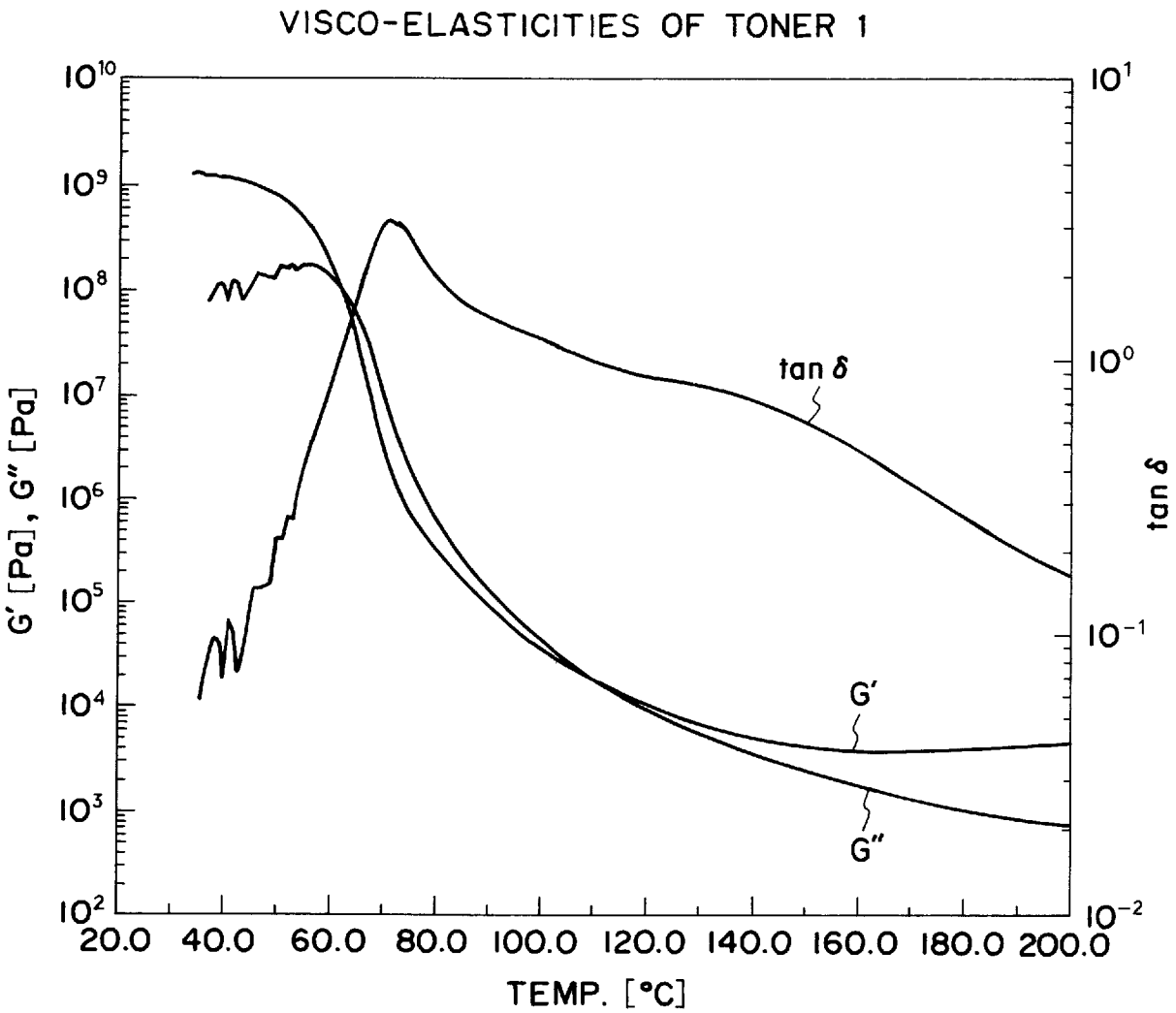
FIG. 1 is a graph showing visco-elastic properties of a toner according to the invention.

The toner according to the present invention is characterized by, among others, excellent low-temperature fixability and anti-low-temperature offset property because of its characteristic visco-elastic properties of:

(a) a storage modulus G' (160° C.) of $8.0\times10^2$–$1.2\times10^4$ Pa, preferably $1.0\times10^3$–$1.0\times10^4$ Pa, further preferably $2.0\times10^3$–$8.0\times10^3$ Pa at 160° C., (b) a loss modulus G" (160° C.) of $4.0\times10^2$–$6.0\times10^3$ Pa, preferably $5.0\times10^2$–$5.0\times10^3$ Pa, further preferably $7.0\times10^2$–$3.0\times10^3$ Pa at 160° C., and (c) a loss tangent tanδ (160° C.)=G" (160° C.)/G' (160° C.) of 0.1–1.5, preferably 0.1–1.0, further preferably 0.2–0.8 at 160° C.

The visco-elastic properties at 160° C. of a toner affect particularly the fixability at a high speed or a low temperature. More specifically, the toner is required to melt quickly because of a short contact time between the toner and the heat-fixing member and have an elasticity so as not to cause low-temperature offset. Because of the above-mentioned visco-elastic properties at 160° C., the toner according to the present invention can exhibit a good fixability even in a high-speed fixing system or at a low temperature.

If G' (160° C.) is below $8.0\times10^2$ Pa, the heated and softened toner can only show a low rubber elasticity, so that the toner cannot be sufficiently separated from the fixing member, thus causing low-temperature offset onto the fixing member. If G' (160° C.) exceeds $1.2\times10^4$ Pa, the low-temperature fixability becomes inferior.

If G" (160° C.) is below $4.0\times10^2$ Pa, the toner becomes softened from a lower temperature, thus being liable to result in traces of separation claw. If G" (160° C.) exceeds $6.0\times10^3$, Pa a good low-temperature fixability cannot be attained.

If tan δ (160° C.) is below 0.1, the storage modulus becomes too large relative to the loss modulus, and the toner excessively shows a property of an elastic material, so that the anti-low temperature-offset property is improved but a sufficient low-temperature fixability cannot be attained. If tan δ (160° C.) exceeds 1.5, the toner is caused to have a high viscosity and a relatively low rubber elasticity, so that the toner is liable to cause melt-sticking onto the photosensitive member, due to heat of friction with the cleaning blade.

Further, the toner according to the present invention exhibits excellent fixability and anti-high-temperature offset property because of its visco-elastic properties of:

(d) a storage modulus G' (190° C.) of $6.0\times10^2$–$1.0\times10^4$ Pa, preferably $8.0\times10^2$–$8.0\times10^3$ Pa, further preferably $1.0\times10^3$–$6.0\times10^3$ Pa, at 190° C., (e) a loss modulus G" (190° C.) of $2.0\times10^2$–$4.0\times10^3$ Pa, preferably $3.0\times10^2$–$3.0\times10^3$ Pa, further preferably $4.0\times10^2$–$2.0\times10^3$ Pa, at 190° C., and (f) a loss tangent tanδ (190° C.)=G" (190° C.)/G' (190° C.) of 0.05–1.2, preferably 0.06–1.0, further preferably 0.08–0.8, at 190° C.

The visco-elastic properties at 190° C. of a toner affect particularly the fixability at a low speed or a high temperature. More specifically, in a low-speed fixing system, the toner contacts the fixing member for a longer time, so that an upper portion of the toner layer on the fixation sheet is liable to attach to the heating roller, thus causing high-temperature offset. Accordingly, a toner is required to exhibit a sufficient elasticity separable from the fixing member even at high temperatures and a viscosity allowing the fixation onto the fixation sheet. Because of the above-mentioned visco-elastic properties at 190° C., the toner according to the present invention can exhibit good fixing performances even in a low-speed fixation system or at a high temperature.

If G' (190° C.) is below $6.0\times10^2$ Pa, the heated and softened toner can only show a low rubber elasticity, so that the toner cannot be sufficiently separated from the fixing member, thus causing high-temperature offset onto the fixing member. If G' (190° C.) exceeds $1.0\times10^4$ Pa, the toner exhibits too high a rubber elasticity, so that the toner shows an inferior fixability onto the fixation sheet.

If G" (190° C.) is below $2.0\times10^2$ Pa, the toner causes an excessive lowering in viscosity when passing along the fixing member, thus being liable to attach onto the fixing member and cause the winding of the fixation sheet about the fixing member. If G" (190° C.) exceeds $4.0\times10^3$ Pa, a good fixability cannot be attained.

If tan δ (190° C.) is below 0.05, the storage modulus becomes too large relative to the loss modulus, and the toner excessively shows a property of an elastic material, so that the anti-high temperature offset property is improved, but a sufficient fixability cannot be attained. If tan δ (190° C.) exceeds 1.2, the toner is caused to have a high viscosity and a relatively low elasticity, so that the toner fixability onto the fixation sheet and the toner releasability from the fixing member are liable to be insufficient, thus causing high-temperature offset of the toner onto the fixing member.

Further, the toner according to the present invention can effectively prevent the winding of the fixation sheet about the fixing member because of G' (160° C.)/G' (190° C.) of 0.5–2.0, preferably 0.6–1.8, further preferably 0.7–1.5.

As for a toner layer on the fixation sheet, an upper portion closer to the fixing member is easily heated compared with a lower portion closer to the fixation sheet. Accordingly, if a toner exhibits visco-elastic properties which are remarkably different depending on temperature, the upper portion and the lower portion of a toner layer are not uniformly transferred at the time when the toner layer is heated and pressed, thus causing a curling of the fixation sheet carrying the fixed toner image leading to the winding of the fixation sheet about the fixing member in some cases. However, such winding about the fixing member can be obviated by the toner according to the present invention which exhibits only a small difference between G' (160° C.) and G' (190° C.).

If G' (160° C.)/G' (190° C.) is below 0.5, the winding about the fixing member can be prevented, but a severe downward curling of the fixation sheet can be caused. If G' (160° C.)/G' (190° C.) exceeds 2.0, the winding of the fixation sheet about the fixing member (particularly a heating roller) is liable to be caused. The downward curling and the winding of the fixation sheet are especially noticeably caused when an image having a high image (density) ratio, such as a solid black image, is fixed.

Further, the toner according to the present invention can effectively prevent the toner attachment onto the fixing member because (h) tan δ (160° C.)>tan δ (190° C.).

When a toner is passed along the fixing member, some portion of the toner is inevitably offset to the fixing member even by a toner of a good fixability. The offset toner is heated to a temperature which is higher than the ordinary toner fixation temperature because it is held on the fixing member. At this time, as the toner according to the present invention retains a storage modulus G' comparable to that at an ordinary fixation temperature, the elastic property of the toner is retained to facilitate the separation of the toner from the fixing member. At the same time, as the toner has a loss modulus which is lower than that at an ordinary fixation temperature, the toner is caused to have a lower viscosity which facilitate the separation of the toner from the fixing member.

In case of tan δ (160° C.)≦tan δ (190° C.), the toner is accumulated on the fixing member surface after the use of the fixing member for a long time, so that the fixed images are accompanied with white dropout at the corresponding part.

It is further preferred that the toner according to the present invention does not assume a minimum of tanδ in a temperature range of 80° C.–200° C., so as to effectively prevent the toner attachment onto the fixing member.

Visco-elastic properties described herein are based on values measured under the following conditions.

Apparatus: Rheometer RDA-II type (available from Rheometrics Co.)

Sample holder: Parallel plates having a diameter of 7.9 mm.

Sample: A toner or a binder resin is heat-molded into a disk of ca. 8 mm in diameter and 2–5 mm in height.

Measurement frequency: 6.28 rad/sec.

Setting of measurement strain: Initially set to 0.1%, followed by measurement in an automatic measurement mode.

Correction of sample elongation: Adjusted in an automatic measurement mode.

Measurement temperatures: From 35° C. to 200° C. at a temperature-increasing rate of 2° C./min.

An example of the measured results for a toner of the present invention is shown in FIG. 1.

Based on a GPC (gel permeation chromatography) chromatogram of its THF (tetrahydrofuran)-soluble content, the toner according to the present invention may preferably exhibit such a molecular weight distribution based on a GPC chromatogram to provide a main peak in a molecular weight region of $3\times10^3$–$4\times10^4$ and contain 1.0–5.0% (by area on the chromatogram) of components in a molecular weight range of $1\times10^5$–$2\times10^5$, 1.0–5.0% of components in a molecular weight range of $2\times10^5$– $5\times10^5$, 0.5–5.0% of components in a molecular weight range of 5×10–$1\times10^6$, and 0.2–6.0% of components in a molecular weight range of $1\times10^6$ or larger.

If the toner contains a THF-soluble content satisfying the above-mentioned molecular weight distribution characterized by definitions of specific proportions in respective molecular weight regions, it becomes possible to effectively improve the low-temperature fixability and anti-high-temperature offset property of the toner. By having a main peak in a molecular weight region of $3\times10^3$–$4\times10^4$, the toner is provided with an improved low-temperature fixability. Further, by containing a substantial amount of components in a molecular weight region of $1\times10^6$ or more, the toner is provided with an improved anti-high-temperature offset property.

Further, by the presence of the components of intermediate molecular weight regions between the molecular weight region of $3\times10^3$–$4\times10^4$ and the molecular weight region of $1\times10^6$ or higher, in addition to the components in the molecular weight region of $3\times10^3$–$4\times10^4$, the components in the molecular weight region of $1\times10^6$ or higher and the crosslinked high-molecular weight components, it is possible to prevent the deterioration of anti-high-temperature offset property liable to be caused by a lowering of the melt-viscosity given by the high-molecular weight components due to intrusion of low-molecular weight components having shorter molecular chains into gaps between the high-molecular weight components. Particularly, the components in the molecular weight region of $1\times10^5$–$2\times10^5$ exhibits a good comparability with the low-molecular weight components and suppresses the migration of the low-molecular weight components into molecular chains of the high-molecular weight components. The components in the molecular weight region of $1\times10^5$–$1\times10^6$ exhibit good compatibility with the high-molecular weight components, thus effectively preventing the intrusion of the low-molecular weight components into the molecular chains of the high-molecular weight components. The components in the molecular weight region of $2\times10^5$–$5\times10^5$ assist the functions of the components in the lower and higher molecular weight regions.

As a further effect attained by the presence of the components in the molecular weight region of $5\times10^5$–$1\times10^6$, the components can improve the dispersion of the low-molecular weight component and the high-molecular weight component in the toner. The low-molecular weight component and high-molecular weight component have inherently different melt-viscosities, so that they are not readily blended with each other during toner production by melt-kneading under heating, thus being liable to cause localization of the toner ingredients and providing toner particles having mutually different molecular weight distributions. As a result, there can be copresent toner particles rich in relatively hard high-molecular weight component and toner particles rich in relatively soft low-molecular weight component, thus causing an irregularity in toner chargeability leading to noticeable fog. By the presence of the component in the intermediate molecular weight region of $5\times10^5$–$1\times10^6$ promoting the blending between the low-molecular weight component and the high-molecular weight component, it becomes possible to prevent noticeable localization of these components in the toner. As a result, it becomes possible to reduce the abnormally chargeable component in the toner, thus reducing the fog in the resultant images.

If a main peak is present in a molecular weight region of below $3\times10^3$, the anti-blocking property of the toner is liable be inferior. If a main peak is present in a molecular weight region in excess of $4\times10^4$, it becomes difficult to obtain a sufficient low-temperature fixability. If the component in the molecular weight region of $1\times10^6$ or higher is present at below 0.2%, the anti-high-temperature offset property is liable to be inferior. If the component of $1\times10^6$ or higher is present in excess of 6.0%, the low-temperature fixability is liable to be inferior. If the content of the components in the molecular weight regions of $1\times10^5$–$2\times10^5$ or $2\times10^5$–$5\times10^5$ is less than 1.0% or the content in the molecular weight region of $5\times10^5$–$1\times10^6$ is below 0.5%, it becomes difficult to attain improvements in the anti-high-temperature offset property and developing performance. If the content of the components in the molecular weight region of $1\times10^5$–$2\times10^5$, $2\times10^5$–$5\times10^5$ or $5\times10^5$–$1\times10^6$ exceeds 5.0 wt. %, the contents of the low-molecular weight component and the high-molecular weight components are relatively reduced, the low-temperature fixability or the anti-high-temperature offset property of the resultant toner is liable to be inferior, and the dispersion of starting materials of toner is liable to be insufficient due to failure in molecular weight balance, thus resulting in toner particles having fluctuation of chargeability and showing inferior developing performance.

It is further preferred that the binder resin and the wax in the toner according to the present invention contain a THF-insoluble content of 1–50 wt. %, preferably 1–40 wt. %, more preferably 5–40 wt. %, further preferably 5–35 wt. %, in order to provide excellent anti-high-temperature offset property. Herein, the THF-insoluble content refers to a highly crosslinked high-molecular weight component, which is effective in providing the toner with a high elasticity, thus providing an improved releasability of the toner from the fixing member and an improved anti-high-temperature offset property of the toner.

If the THF-insoluble content is below 1 wt. %, the fixed toner image is liable to be wound about the fixing member. If the THF-insoluble content exceeds 50 wt. %, the toner is liable to be excessively hard to damage the photosensitive member and cause the toner melt-sticking onto the photosensitive member.

It is further preferred that the THF-soluble content of the toner according to the present invention provides a GPC chromatogram showing a main peak in a molecular weight region of $4\times10^3$–$3\times10^4$ and a sub-peak in a molecular weight region of $7\times10^2$–$3\times10^3$ so as to provide a further better low-temperature fixability. If a sub-peak is present in a molecular weight region of below $7\times10^2$, the anti-blocking property of the resultant toner is liable to be inferior and, even if a sub-peak not overlapping with the main peak is present in a molecular weight region in excess of $3\times10^3$, it is difficult to attain an improvement in low-temperature fixability.

If the toner according to the present invention satisfies the above-mentioned molecular weight distribution characteristic in addition to the visco-elastic properties, it is possible to achieve the low-temperature fixability, anti-low-temperature offset property and anti-high-temperature offset property more effectively.

Further, by preventing the occurrence of troubles around the fixing device and the latent image-forming section, the occurrence of paper jamming is suppressed, thereby improving the reliability of the image forming apparatus inclusive of continuous image forming performances.

The molecular weight distribution of THF-soluble contents of toners described herein are based on GPC measurement performed according to the following manner.

In the GPC apparatus, a column is stabilized in a heat chamber at 40° C., tetrahydrofuran (THF) solvent is caused to flow through the column at that temperature at a rate of 1 ml/min., and about 100 $\mu$l of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$) G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

The GPC sample may be prepared as follows.

A resinous sample is placed in THF and left standing for several hours (e.g., 5–6 hours). Then, the mixture is sufficiently shaken until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.2–0.5 $\mu$m (e.g., "Maishoridisk H-25-5", available from Toso K.K.) to recover the filtrate as a GPC sample. The sample concentration is adjusted to provide a resin concentration within the range of 0.5–5 mg/ml.

The THF-insoluble content of a toner is measured in the following manner.

Ca. 0.5–1.0 g of a sample is weighed (at $W_1$ g), placed in a cylindrical filter (e.g., "No. 86R", available from Toyo Roshi K.K.) and then subjected to extraction with 200 ml of solvent THF in a Soxhlet's extractor for 12 hours. The solvent is evaporated from the extract solution to leave a THF-soluble resin content, which is dried under vacuum at 100° C. for several hours and then weighed (at $W_2$ g). The weight of components, such as a magnetic material or a pigment, other than the resinous component is determined (at $W_3$ g). THF-insoluble content ($THF_{ins.}$) is calculated as follows:

$$THF_{ins.}\ (\text{wt. }\%)=[W_1-(W_2+W_3)]/(W_1-W_3)\times100.$$

The toner according to the present invention may be provided with the above-mentioned specific visco-elastic properties, e.g., by appropriately crosslinking the polymer chains of the binder resin. This may be accomplished by combining plural crosslinking reactions providing different crosslinking structures.

Examples of the crosslinking reactions adoptable in the present invention may include: copolymerization using a polyfunctional vinyl monomer having two or more vinyl groups; polycondensation using monomers, at least one of which is polyfunctional (i.e., three or more functional (e.g., hydroxyl or carboxyl) groups; crosslinking between functional groups of polymer molecules having such a functional group via a reactive compound capable of reacting with the functional group; reaction between a first polymer having a functional group and a second polymer having a functional group reactive with the functional group of the first polymer; crosslinking by polycondensation of addition polymer(s); and crosslinking by addition polymerization of condensation polymer(s).

Different crosslinking reactions provide different crosslinking structures having differences in various properties, such as degree of crosslinking, thermal decomposition characteristic, distance between crosslinking points, length of crosslinkage, and/or flexibility of crosslinkage (mobility of crosslinking chain). Accordingly, it is preferred to combine a plurality of the above-mentioned crosslinking reactions to provide the toner according to the present invention with the above-mentioned specific visco-elastic properties, i.e., specific elasticity and loss tangent, and maintenance of storage modulus and decrease in loss tangent on temperature increase to a high temperature.

Such plural crosslinking reactions including first crosslinking and second crosslinking may be performed at the time of either binder resin preparation or toner preparation, or alternatively at the time of binder resin preparation and also subsequent toner preparation. It is also possible that such first and second crosslinkings separately. Preferred method may include: a method comprising the first crosslinking in the binder resin preparation and the second crosslinking in the toner preparation; a method comprising the first crosslinking in the binder resin preparation and the first and the second crosslinkings in the toner preparation; and a method comprising the first and second crosslinkings in the toner preparation. It is particularly preferred to adopt either the method comprising the first crosslinking in the binder resin preparation and the second crosslinking in the toner preparation, or the method comprising the first crosslinking in the binder resin preparation and the first and second crosslinkings in the toner preparation.

In the present invention, it is preferred to produce a toner containing a binder resin having at least two different types of crosslinkages formed by using a resin having a crosslinkage through a first linking and subjecting to the resin to a second crosslinking, in order to provide improved fixability, improved anti-offset property, improved anti-blocking property, improved releasability from the photosensitive member and prevention of fixing roller soiling.

In order to improve the releasability, separability and anti-curling stability, prevent the traces of separation claw and reduce the fog of fixed images or recording sheets carrying the fixed images, it is particularly preferred to effect a first crosslinking to form a crosslinked resin having a functional group, and then effect a second crosslinking during the toner preparation by melt-kneading the crosslinked resin together with other toner ingredients inclusive of a reactive compound or a reactive polymer reactive with the functional group of the crosslinked resin, a wax and a colorant to form a crosslinkage between the functional groups of the crosslinked resin via the reactive compound or the reactive polymer.

This is because the thus-provided toner containing the resin provided with two types of crosslinkages exhibits the above-mentioned viscosity, elasticity and temperature-dependent changes thereof which are ideally harmonized with thermal behaviors of the toner and the toner image required at the time of fixation in the heat-fixing system.

As a method for preparing the toner having the above-mentioned specific visco-elastic properties according to the present invention, it is particularly preferred to effect a first crosslinking by reacting a resin having an acid group with a reactive compound or polymer, and then further effect a second crosslinking to provide a crosslinkage via a second reactive compound or polymer.

The first crosslinking may preferably be performed by: copolymerization using a polyfunctional vinyl monomer, polycondensation using monomers, at least one of which is polyfunctional; crosslinking between functional groups of polymer molecules having such a functional group via a reactive compound capable of reacting with the reactive group; reaction between a first polymer having a functional group and a second polymer having a functional group reactive with the functional group of the first polymer; graft reaction using a polymerization initiator; crosslinking by polycondensation of addition polymer(s); or crosslinking by addition polymerization of condensation polymer(s).

Particularly preferred modes of the first crosslinking may include: crosslinking between functional groups of polymer molecules having such a functional group via a reactive compound capable of reacting with the reactive group; and reaction between a first polymer having a functional group and a second polymer having a functional group reactive with the functional group of the first polymer.

Preferred examples of the second crosslinking may include: crosslinking between functional groups of polymer molecules having such a functional group via a reactive compound capable of reacting with the reactive group; reaction between a first polymer having a functional group and a second polymer having a functional group reactive with the functional group of the first polymer.

It is particularly preferred to effect the second crosslinking by crosslinking between functional groups of polymer molecules having such a functional group via a reactive compound capable of reacting with the reactive group.

The second crosslinking may preferably be effected during the melt-kneading for toner preparation.

Examples of the functional group contributing to the crosslinking may include: carboxyl, acid anhydride, ester susceptible of trans-esterification, hydroxyl, amino, imino, glycidyl, epoxide, active methylene, double bond, cyano, isocyanate, and vinyl. The crosslinking may be effected by a bonding reaction between these functional groups to form an ester bond, amide bond, imide bond or carbon-to-carbon bond, thereby forming a crosslinkage between polymer chains at the time of binder resin preparation or melt-kneading for toner preparation to provide the visco-elastic properties characterizing the toner of the present invention. It is also possible to form a cross-linkage between functional groups of polymer chains having such a functional group via a reactive compound, such as acid, alcohol, amine, imine, epoxide, acid anhydride, ketone, aldehyde, amide, ester, lactone, or lactam. This may also be performed during the binder resin preparation or melt-kneading for toner preparation. It is also possible to effect a crosslinking during the melt-kneading for toner preparation by a coordinate bond or ion bond via a metal of metal-containing compound, such as a metal salt, a metal complex or an organo-metallic compound; or an ester bond or amide bond via a nitrogen-containing compound, an epoxy compound, an alcohol compound or a carboxylic acid compound. A particularly preferred form a crosslinking may be performed by using a binder resin, such as a polyester resin or vinyl resin, having an acid group (such as carboxyl or acid anhydride), a hydroxyl group, an amino group, an imino group or a glycidyl group, and forming a crosslinkage via a glycidyl compound, an amine compound, an epoxy compound, a carboxylic acid compound or an alcohol compound, or via a metal of a metal salt, a metal complex or an organometallic compound. It is particularly preferred to include plural forms of such crosslinkages.

It is particularly preferred to prepare a toner having the above-described visco-elastic properties and molecular weight distribution by subjecting a resin having an acid group to a crosslinking ia a reactive compound, such as a glycidyl compound, and further to a crosslinking via a metal of a metal-containing compound or a second reactive compound.

A crosslinkage via a glycidyl compound may be introduced into a binder resin, e.g., by mixing in solution a copolymer of a glycidyl group-containing vinyl monomer and a styrene monomer with a copolymer of a vinyl monomer containing an acid group such as carboxyl or acid anhydride and a styrene monomer. The above-mentioned desirable visco-elastic properties of the toner may be provided by using such a binder resin, if desired, with further crosslinking with other toner ingredients in the melt-kneading step for toner preparation. Such a glycidyl group-containing copolymer may preferably have a weight-average molecular weight (Mw) of $4\times10^3$–$1\times10^5$, more preferably $5\times10^3$–$5\times10^4$, based on molecular weight distribution according to GPC.

Examples of glycidyl group-containing vinyl monomer may include: glycidyl acrylate, glycidyl methacrylate, β-methylglycidyl acrylate, β-methylglycidyl methacrylate, allyl glycidyl ether, and allyl β-methylglycidyl ether.

Such a glycidyl compound may preferably be used in an amount of 0.05–10 equivalents, preferably 0.1–5 equivalents, per mol of a functional group, such as acid group.

The metal-containing compound for providing a crosslinkage may be a metal salt or a metal complex. Examples of metal ions contained therein may include: mono-valent metal ions, such as $Na^+$, $Li^+$, $K^+$, $Cs^+$, $Ag^+$, $Hg^+$, and $Cu^+$; divalent metal ions, such as $Be^{2+}$, $Ba^{2+}$, $Mg^{2+}$, $Ca^{2+}$, $Hg^{2+}$, $Sn^{2+}$, $Pb^{2+}$, $Mn^{2+}$, $Fe^{2+}$, $Ce^{2+}$, $Ni^{2+}$, and $Zn^{2+}$; tri-valent ions, such as $Al^{3+}$, $Sc^{3+}$, $Fe^{3+}$, $V^{3+}$, $Co^{3+}$, $Ni^{3+}$, $Cr^{3+}$ and $Y^{3+}$; and tetra-valent ions, such as $Ti^{4+}$ and $Zr^{4+}$.

Among such metal-containing compounds, organometallic compounds are preferred because of good mutual solubility or dispersibility within a polymer so that the crosslinking therewith is allowed to uniformly proceed in the polymer, thereby providing better results.

Among such organometallic compounds, those containing an organic compound rich in volatility or sublimability as a ligand or a counter ion may be advantageously used. Examples of such organic compounds may include: salicylic acid and derivatives thereof, such as salicylic acid, salicylamide, salicylamine, salicylaldehyde, salicylosalicylic acid, and di-tert-butylsalicylic acid; diketones, such as acetylacetone and propionacetone; low-molecular weight carboxylic acid salts, such as acetic acid salt and propionic acid salt; hydroxycarboxylic acids; and dicarboxylic acids.

Other preferable ligands may include: azo compound derivatives, heterocyclic compounds such as imidazole derivatives and aromatic compounds in view of mutual solubility with the binder resin and influence on the developing performance.

The metal-containing compound may preferably be contained in 0.01–20 wt. parts, more preferably 0.1–10 wt. parts, per 100 wt. parts of the binder resin. Below 0.01 wt. part, the contribution thereof to the crosslinking may not be significant, and in excess of 20 wt. parts, the chargeability of the resultant toner is liable to be unstable, thus being liable to fail in stable developing performance in continuous image formation.

The reactive compound other than the metal containing compound and usable for providing a crosslinkage may preferably be a compound having at least two functional groups which may be identical or different and selected from hydroxyl groups, epoxide groups and amide groups (in a sense of including imino group), preferably be such an aromatic compound or a nitrogen-containing heterocyclic compound in a sense of including a compound including plural aromatic rings or heterocyclic rings having such a functional group bonded with an arbitrary bonding group. Taking amino group for example, examples of such compounds may include: aliphatic, alicyclic and aromatic amines; aliphatic aromatic amines; polynuclei amines, inclusive of ether-type amines, hydrocarbon-type amines and fluoreneamine; imide-type amines; alkyl ester-type amines; and amines represented by the following formula (1):

(1)

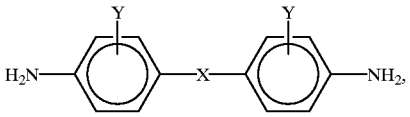

wherein X represents a direct bond or an arbitrary bonding group; and Y denotes an arbitrary optional substituent, preferably alkyl, fluoroalkyl or thioalkyl.

Incidentally, other reactive compounds may include those indicated by replacing both (or either one) of the amino groups ($NH_2$) in the formula (1) with hydroxyl, epoxide or carboxyl group.

The crosslinking via such a reactive compound may be effected, e.g., by melt-kneading a polymer having a functional group in the presence of a reactive compound under a high shearing force, or by melt-kneading a polymer including a crosslinked polymer component in the presence of a reactive compound. As a result, the resultant toner is provided with various structures of crosslinkages providing the prescribed visco-elastic properties and molecular weight distribution.

In addition to the above, it is also possible to use a crosslinking monomer for effecting a crosslinking during polymerization for providing a binder resin. Such a crosslinking monomer may principally be a vinyl monomer having at least two polymerizable double bonds and it may be preferable to use two or more species of such a crosslinking monomer in combination in some cases.

Specific examples of such a crosslinking monomer may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylpropane triacrylate, tetramethylolmethane tetracrylate, oligoester acrylate, and compounds obtained by substituting methacrylate groups for the acrylate groups in the above compounds; triallyl cyanurate and triallyl trimellitate.

As a component for effecting the crosslinking during the polycondensation, it is possible to include a polyhydric alcohol or/and a polybasic acid each having three or more functional groups also functioning as a crosslinking component in combination with the above mentioned alcohol and acid.

Examples of such polyhydric alcohols may include: sorbitol, 1,2,3,6-hexanetetrol, 1,4-sorbitane, pentaerythritol, dipentaerythritol, tripentaerithritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of polybasic carboxylic acids may include: trimellitic acid, pyromellitic acid, 1,2,4-benzentricarboxylic acid, 1,2,5-benzentricarboxylic acid, 2,5,7-naphthalenetricarboxylic acid, 1,2,4naphthalenetricarboxylic acid, 1,2,4-butanetricarboxylic acid, 1,2,5-hexanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, empole trimer acid, and their anhydrides and lower alkyl esters; and also tetracarboxylic acids represented by the following formula (C):

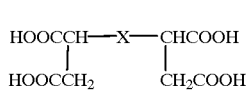

(C)

(wherein X is an alkylene or alkenylene group having 1–30 carbon atoms and capable of having one or more side chains of one or more carbon atoms) and anhydride and lower alkyl esters thereof.

Examples of the initiator used for graft crosslinking may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylonitrile, 2,2'-azobis(2-methylbutyro-nitrile, 2,2'azobis(2,4-dimethylvaleronitrile), 2,2'-azobis(4methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy)hexane, di-t-butyldiperoxyisophthalate, 2,2-bis(4,4-di-t-butylperoxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di-(t-butylperoxy)hexane, diethylene glycol-bis(t-butylperoxycarbonate), di-t-butylperoxytrimethylazipate, tris(t-butylperoxy)triazine, and vinyltris(t-butylperoxy)silane. These initiators may be used singly or in combination in an amount of at least 0.05 wt. part, preferably 0.1–15 wt. parts, per 100 wt. parts of the monomer.

The polyester resin used in the present invention may be constituted as follows.

Examples of the resin having a functional group may include: vinyl polymers, polyester resin, epoxy resin, polyamide resin, polyurethane resin, silicone resin, phenolic resin, polyvinyl butyral resin, rosin, modified rosin, terpene resin, aliphatic or alicyclic hydrocarbon resin, aromatic petroleum resin, natural resin-modified maleic acid resin, and furan resin. These resins may be used singly or in mixture. A part or all of such resins constituting the binder resin may be provided with a functional group. Vinyl polymers and polyester resins are particularly preferred.

For example, a vinyl polymer-type binder resin may be provided with an acid group by using a carboxylic acid monomer or a carboxylic acid derivative monomer, examples of which may include: maleic acid, citraconic acid, dimethylmaleic acid, itaconic acid, alkenylsuccinic acid and anhydrides of these; unsaturated dibasic acids, such as fumaric acid, mesaconic acid and dimethylfumaric acid, and monoesters of such unsaturated dibasic acids; acrylic acid, methacrylic acid, crotonic acid, cinnamic acid and anhydrides of these; α,β-unsaturated acids described above, and anhydrides with lower aliphatic acids, and anhydrides of such α,β-unsaturated acids alkenylmalonic acid, alkenylglutaric acid, alkenyladipic acid, and anhydride and monoesters of these.

Among the above, it is particularly preferred to use a monoester of α,β-unsaturated dibasic, such as maleic acid, fumaric acid or succinic acid, acrylic acid or methacrylic acid as a monomer for providing an acid group to the binder resin used in the present invention. Preferred examples of such monoesters may include: monomethyl maleate, monoethyl maleate, monobutyl maleate, monooctyl maleate, monoallyl maleate, monophenyl maleate, monomethyl fumarate, monoethyl fumarate, monobutyl fumarate, monophenyl fumarate, monobutyl n-butenylsuccinate, monomethyl n-octenylsuccinate, monoethyl n-butenylmalonate, monomethyl n-dodecenylglutarate, and monobutyl n-butenyladipate.

Examples of vinyl monomers as comonomers for providing vinyl polymers having an acid group together with a carboxylic acid (derivative) monomer as described above may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylate, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide. These vinyl monomers may be used singly or in combination of two or more species.

Among these, a combination of monomers providing styrene-based copolymers and styrene-acrylate-based copolymers may be particularly preferred.

It is also possible to use a crosslinking vinyl monomer having two or more polymerizable double bonds as a portion of comonomers for providing vinyl polymers having an acid group together with a carboxylic acid (derivative) monomer as described above. Such a crosslinking vinyl monomer may be selected from the above-mentioned list of crosslinking monomers.

Such a crosslinking vinyl monomer may preferably be used in a proportion of ca. 0.01–5.0 wt. parts, more preferably 0.03–3.0 wt. parts, per 100 wt. parts of the other monomers. Below 0.01 wt. part, a substantial contribution thereof to the crosslinking thereby cannot be expected. Above 5.0 wt. parts, excessive crosslinkage may be incorporated, thus being liable to invite deterioration of fixability and dispersibility of other toner ingredients in the binder resin.

As described above, the above-mentioned specific visco-elastic properties may be provided to the toner according to the present invention by appropriately combining the selection and/or control of the binder resin composition, the types of the first and second crosslinking reactions, the points of time for effecting the first and second crosslinking reactions, and the conditions of the first and second crosslinking reactions. However, for the purpose of commercial production of toners, it is desired to produce a high-performance toner at a high productivity.

In view of this, the toner according to the present invention may particularly preferably be formed through a two-stage crosslinking process wherein the first crosslinking reaction is effected at least in the step producing a binder resin and the second crosslinking reaction is effected in the step of melt-kneading the binder resin with other toner ingredients for toner production. It is further preferred that the first crosslinking reaction is effected in the binder resin production step and also successively in the melt-kneading step.

The two-stage crosslinking process allows the production of the toner according to the present invention having the specific visco-elastic properties by combining a plurality of crosslinking reactions having mutually different reaction speeds while controlling the crosslinking states formed by the respective crosslinking reactions. Particularly, as the second crosslinking reaction is effected in the melt-kneading step for toner production, the temperature and shearing force applied to the toner composition can be strictly controlled by kneading conditions of the kneading machine to adjustively provide desired visco-elastic properties within the specified range of the present invention.

The kneading conditions of the kneading machine can be appropriately selected so as to provide desired properties depending on the composition to be kneaded, i.e., the binder resin, wax, crosslinking agent and other ingredients.

Depending on the types of crosslinking reactions and binder resin, it is also possible to adopt a one-stage crosslinking process wherein the first and second crosslinking reactions are both effected in the melt-kneading step for toner production, instead of the two-stage crosslinking process.

As for the most preferred combination of the crosslinking reactions, the first crosslinking reaction comprises a relatively slow reaction between a polymer having a carboxyl group and a compound (or polymer) having a glycidyl group or hydroxyl group, i.e., a reaction between the carboxyl group and the glycidyl or hydroxyl group, and the second crosslinking reaction comprises a relatively fast reaction between a polymer having a carboxyl group and a glycidyl or hydroxyl group formed after the crosslinking reaction, and a metal-containing or a nitrogen-containing compound having an amino or imino group, including a reaction between the carboxyl group and the metal atom, metal ion, or amino or imino group.

It is difficult to sufficiently cause the relatively slow first crosslinking reaction in the melt-kneading step in a controlled manner. On the other hand, the relatively fast second crosslinking reaction is liable to proceed excessively when performed in the binder production step. As a result, in both cases, it is difficult to form a toner having the visco-elastic properties prescribed in the present invention.

Accordingly, in the above-mentioned combination of the first crosslinking reaction between a carboxyl group-containing polymer and a glycidyl group or hydroxyl group-containing compound (or polymer), and the second crosslinking reaction between a polymer having a carboxyl group and a glycidyl or hydroxyl group formed by the first crosslinking reaction and a metal-containing compound or a nitrogen (i.e., amino or imino group)-containing compound, the two-stage crosslinking process capable of easily controlling the respective crosslinking reactions is preferred than the one-stage crosslinking process.

By optionally controlling different crosslinking reactions for providing specific forms of crosslinkages of resins through such a two-stage crosslinking process, the resultant toner can be provided with the specific visco-elastic properties in a controlled manner while achieving the good dispersion state of toner ingredients, whereby a toner exhibiting excellent performances can be produced stably and at a high productivity.

The vinyl polymer-type binder resin used in the present invention may be prepared by solution polymerization, bulk polymerization, suspension polymerization or emulsion polymerization in the presence of a polymerization initiator.

Such a polymerization initiator may be appropriately selected from the above-mentioned list of initiators used for graft crosslinking. In the polymerization for providing the binder resin, such a polymerization initiator may preferably be used in a proportion of at least 0.05 wt. part, more preferably 0.1–15 wt. parts, per 100 wt. parts of the monomer(s) constituting the binder resin.

It is also preferred to use a polyester resin as the binder resin. A preferred composition of such a polyester resin is described below.

Examples of a dihydric alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

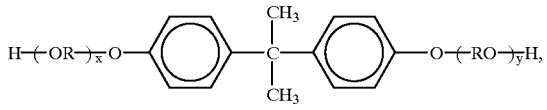

wherein R denotes an ethylene or propylene group, x and y are independently 0 or a positive integer with the proviso that the average of x+y is in the range of 0–10; diols represented by the following formula (B):

(B)

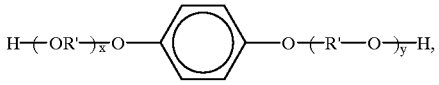

wherein R' denotes

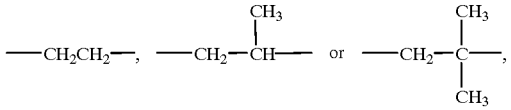

x' and y' are independently 0 or a positive integer with the proviso that the average of x'+y' is in the range of 0–10.

A dibasic acid component may be a dibasic acid or derivative thereof, examples of which may include benzenedicarboxylic acids, such as phthalic acid, terephthalic acid and isophthalic acid, and their anhydrides and lower alkyl esters; alkyldicarboxylic acids, such as succinic acid, adipic acid, sebacic acid and azelaic acid, and their anhydrides and lower alkyl esters; alkyl or alkenyl-substituted succinic acids, and their anhydrides and lower alkyl esters; and unsaturated dicarboxylic acids, such as fumaric acid, maleic acid, citraconic acid and itaconic acid, and their anhydrides, and derivatives of these.

It is preferred to use a polyhydric alcohol or/and a polybasic acid each having three or more functional groups also functioning as a crosslinking component in combination with the above mentioned alcohol and acid.

Examples of such polyhydric alcohols may include: sorbitol, 1,2,3,6-hexanetetrol, 1,4-sorbitane, pentaerythritol, dipentaerythritol, tripentaerithritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of polybasic carboxylic acids may include: trimellitic acid, pyromellitic acid, 1,2,4-benzentricarboxylic acid, 1,2,5-benzentricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, empole trimer acid, and their anhydrides and lower alkyl esters; and also tetracarboxylic acids represented by the following formula (C):

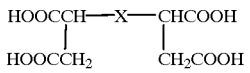

(C)

(wherein X is an alkylene or alkenylene group having 1–30 carbon atoms and capable of having one or more side chains of one or more carbon atoms) and anhydride and lower alkyl esters thereof.

The polyester may desirably comprise 40–60 mol. %, preferably 45–55 mol. % of alcohol component and 60–40 mol. %, preferably 55–45 mol. % of acid component. The polyfunctional component may be used in a proportion of 5–60 mol. % of the total components.

Examples of the wax used in the present invention may include: paraffin wax and its derivatives, montan wax and its derivatives, microcrystalline wax and its derivatives, Fischer-Tropsche wax and its derivatives, polyolefin wax and its derivatives, and carnauba wax and its derivatives. The derivatives include oxides, block copolymers with vinyl monomers and graft-modified products.

In addition to the above, it is also possible to use alcohol, aliphatic acid, ester, ketone, hardened castor oil and its derivative, vegetable wax, animal wax, mineral wax or petrolactam.

Preferred examples of waxes used in the present invention may include: paraffin waxes; low-molecular weight polyolefin formed by polymerization of olefin by radical polymerization or in the presence of a Ziegler catalyst, and by-products in such polymerization; low-molecular weight polyolefin formed by thermal decomposition of high-molecular weight polyolefin; distillation residue from hydrocarbons synthesized from a gaseous mixture of carbon monoxide and hydrogen in the presence of a catalyst, or waxes obtained from hydrocarbons formed by hydrogenating such distillation residues; esters; montan derivatives; and aliphatic acids purified by removal of impurities. It is possible to add an anti-oxidant to those waxes.

A particularly preferred class of waxes may include: paraffin waxes, products obtained by polymerizing olefins, such as ethylene, in the presence of a Ziegler catalyst and by-products from the polymerization; waxes based on hydrocarbons having up to several thousands carbon atoms, preferably up to 1000 carbon atoms, such as Fischer-Trapshe wax.

It is also preferred to use a wax product having a narrower molecular weight distribution by fractionating the above-mentioned waxes according to press sweating, solvent method, vacuum distillation, super critical gas extraction or fractional crystallization (such as melt-crystallization or crystal filtration). It is also possible to subject such a wax product after fractionation to oxidation, block copolymerization or graft-modification. For example, the fractionation may be applied for removal of a low-molecular weight component or extraction of a low-molecular weight component, optionally followed by removal of a low-molecular weight component, so as to provide an arbitrary molecular weight distribution.

The wax used in the present invention may preferably have such a molecular weight distribution as to provide a number-average molecular weight (Mn) of 200–1200, more preferably 250–1000, a weight-average molecular weight (Mw) of 300–3600, more preferably 350–3000, and an Mw/Mn ratio of at most 3, more preferably at most 2.5, particularly preferably at most 2.0.

If the wax has an Mn of below 200 or an Mw of below 300, it becomes difficult to obtain a sufficient improvement in anti-offset property. In case of Mn exceeding 1200 or Mw exceeding 3600, it becomes difficult to obtain a sufficient improvement in fixability. In case of Mw/Mn exceeding 3, it becomes difficult to achieve the improvement in fixability and anti-offset property in combination as well as the maintenance of storage stability.

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

A GPC sample may be prepared in the following manner.

A wax sample is placed in o-dichlorobenzene in a beaker heated on a heater set at 150° C. to dissolve the sample. After the sample is dissolved, the sample solution is placed in a filter unit and set in the GPC apparatus so that a GPC sample at a concentration of 0.15 wt. % having passed through the filter unit is supplied for the GPC measurement.

The wax used in the present invention may preferably have a melting point of 70–155° C. and a melt-viscosity at 160° C. of at most 500 mPa.s, more preferably a melting point of 75–140° C. and a melt-viscosity at 140° C. of at most 500 mPa.s, particularly preferably a melting point of 75–125° C. and a melt-viscosity at 120° C. of at most 500 mpa.s.

If the melting point of the wax is below 70° C., the anti-blocking property of the resultant toner is liable to be inferior. In excess of 155° C., it becomes difficult to achieve the improvements in fixability and anti-low-temperature offset property. If the wax has a melt-viscosity at 160° C. in excess of 500 mPa.s, it becomes difficult to achieve the improvement in toner releasability.

The melting point of a wax referred to herein is based on values measured by using a differential scanning calorimeter ("DSC-7", available from Perkin-Elmer Corp.) according to ASTM D3418-82 in the following manner.

A sample in a weight of 2–10 mg, preferably ca. 5 mg, is accurately weighed, placed in an aluminum pan and then subjected to a DSC measurement at a temperature-raising rate of 10° C./min. in a temperature range of 30–200° C. while using a blank aluminum pan as a reference.

During the temperature increase, a heat-absorption main peak is observed on a DSC curve in the temperature range of 30–200° C. The peaktop temperature of the heat-absorption main peak is taken as a melting point referred to herein.

The melt-viscosity of a wax referred to herein is based on values measured by using a rotary viscometer ("VT-500", available from Haake Co.) with respect to a sample held in container placed on a temperature-regulated oil both adjusted at a prescribed temperature (e.g., 160° C.) for measurement under a shear rate of 6000 $s^{-1}$ while using a sensor of PK1, 0.5 deg.

In the present invention, the wax may preferably be used in 0.1–15 wt. parts, more preferably 0.5–12 wt. parts, per 100 wt. parts of the binder resin. It is possible to use a plurality of waxes in combination so as to provide a total amount as mentioned above.

The toner according to the present invention can contain a colorant comprising any suitable pigment or dye. For example, suitable examples of the pigment may include: carbon black, aniline black, Naphthol Yellow, Hansa Yellow, Rhodamine Lake, Alizarin Lake, red iron oxide, Phthalocyanine Blue, and Indanthrene Blue. Such a pigment may be used in an amount necessary to provide a required optical density of fixed image, e.g., 0.1–20 wt. parts, preferably 0.2–10 wt. parts, per 100 wt. parts of the binder resin. For similar purpose, a dye may be used. There are, for example, azo dyes, anthraquinone dyes, xanthene dyes and methin dyes, which may be added in 0.1–20 wt. parts, preferably 0.3–10 wt. parts, per 100 wt. parts of the binder resin.

The toner according to the present invention can also be formed as a magnetic toner by containing a powdery magnetic material which can also function as a colorant. Examples of such a powdery magnetic material may include: iron oxide, such as magnetite, hematite and ferrite; metals, such as iron, cobalt and nickel, and alloys of these metals with another element, such as aluminum, copper, lead, magnesium, tin, zinc, antimony, beryllium, bismuch, cadmium, calcium, manganese, selenium, titanium, tungsten and vanadium, and mixtures of these.

The magnetic material may preferably have a number-average particle size of at most 2 $\mu$m, more preferably 0.1–0.5 $\mu$m. In excess of 2 $\mu$m, it becomes difficult to exhibit a sufficient coloring power. The number-average particle size of a magnetic material may for example be determined by measuring longer-axis diameters of 100 particles selected at random on photographs taken at a magnification of $2\times10^4$–$5\times10^4$ through a transmission microscope and taking an average of the measured long-axis diameters by using a digitizer, etc.

Such a magnetic material may preferably be contained in 20–200 wt. parts, more preferably 40–150 wt. parts, per 100 wt. parts of the binder resin in the toner.

If the content of the magnetic material is below 20 wt. parts, it is difficult to attain a sufficient coloring power, and in excess of 200 wt. parts, the fixability is liable to be impaired.

The magnetic material may preferably have magnetic particles as measured by application of $7.96\times10^2$ kA/m including a coercive force (Hc) of 1.6–23.9 kA/m, a saturation magnetization ($\sigma_s$) of 50–200 $Am^2$/kg, and a residual magnetization ($\sigma_r$) of 2–20 $Am^2$/kg.

By satisfying the above-mentioned magnetic properties, the magnetic material may provide a magnetic toner capable of providing fog-free images having a high image density and excellent in resolution and gradation characteristic.

The toner according to the present invention may preferably further contain a positive or negative charge control agent.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among these, it is preferred to use a triphenylmethane lake pigment.

Examples of the negative charge control agent may include: organic metal complexes, chelate compounds, monoazo metal complexes, acetylacetone metal complexes, organometal complexes of aromatic hydroxycarboxylic acids and aromatic dicarboxylic acids, metal salts of aromatic hydroxycarboxylic acids, metal salts of aromatic polycarboxylic acids, and anhydrides and esters of such acids, and phenol derivatives, such as bisphenols.

The toner according to the present invention may preferably have a weight-average particle size (D4) of 4–10 $\mu$m, more preferably 5–9 $\mu$m.

If the weight-average particle size of the toner exceeds 10 $\mu$m, the toner coverage on the resultant toner image is liable to be excessive, thus resulting in inferior thin-line reproducibility, and result in traces of separation claw. Below 4 $\mu$m, the toner coverage is liable to be insufficient, thus resulting in a decrease in image density especially in a large area image, and result in the winding of the recording sheet about the fixing member.

The weight-average particle size and particle size distribution of a toner may be measured according to the Coulter counter method, e.g., by using Coulter Counter Model TA-II or Coulter Multisizer II (available from Coulter Electronics Inc.) together with an electrolytic solution comprising a ca. 1% NaCl aqueous solution which may be prepared by dissolving a reagent-grade sodium chloride or commercially available as "ISOTON-II" (from Counter Scientific Japan). For measurement, into 100 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the abovementioned apparatus equipped with a 100 $\mu$m-aperture. The volume and number of toner particles having particle sizes of 2.00 $\mu$m or larger are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m, 10.08–12.70 $\mu$m;

12.70–16.00 μm; 16.00–20.20 μm; 20.20–25.40 μm; 25.40–32.00 μm: and 32.00–40.30 μm.

It is preferred to use the toner according to the present invention together with silica fine powder externally blended therewith in order to improve the charge stability, developing characteristic fluidity, and durability.

The silica fine powder may preferably have a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also possible to use two or more treating agents in combination.

The toner according to the present invention can further contain other additives, inclusive of: powdery lubricants, such as polytetrafluoroethylene powder, zinc stearate powder and polyvinylidene fluoride powder, with polyvinylidene fluoride powder as a particularly preferred one; powdery abrasives, such as cerium oxide powder, silicon carbide powder and strontium titanate powder, with strontium titanate powder as a particularly preferred one; flowability-improving agents, such as titanium oxide powder and aluminum oxide powder, which are preferably hydrophobized; anti-caking agent; electroconductivity-imparting agents, such as carbon black powder, zinc oxide powder, antimony oxide powder and tin oxide powder; and developing performance-improver agents, such as white fine particles and black fine particles of opposite polarity, respectively in relatively small amounts.

The toner according to the present invention may be used for providing a mono-component type developer or a two-component type developer. In the case of providing a two-component type developer, the toner may be blended with carrier powder in a ratio suitable for providing a toner concentration of 0.1–50 wt. %, preferably 0.5–10 wt. %, further preferably 3–10 wt. %.

The carrier used for this purpose may be known ones, inclusive of powdery magnetic materials, such as iron powder, ferrite powder and nickel powder; glass beads; and resin coated materials formed by coating such carrier materials with a resin, such as fluorine-containing resin, vinyl resin or silicone resin.

The toner according to the present invention may be prepared through a process including: sufficiently blending the binder resin, the wax, a colorant, such as pigment, dye and/or a magnetic material, a metal-containing compound, and an optional charge control agent and other additives, as desired, by means of a blender such as a Henschel mixer or a ball mill, melting and kneading the blend by means of hot kneading means, such as hot rollers, a kneader or an extruder to cause melt-kneading of the resinous materials and disperse or dissolve the wax, pigment or dye therein, and cooling and solidifying the kneaded product, followed by pulverization and classification.

The thus obtained toner may be further blended with other external additives, as desired, sufficiently by means of a mixer such as a Henschel mixer to provide a toner for developing electrostatic images.

In the present invention, it is particularly significant as mentioned above to use a binder resin having a functional group and a reactive compound and subject these materials to crosslinking during the melt-kneading step for toner production. For effectively causing the crosslinking, it is important to appropriately set the heating temperature and the paddle or screw organization of the kneading machine so as to provide a high resin temperature during the kneading and a long residence time of the resin in the kneading machine.

More specifically, it is preferred to form a kneading section by combining a reverse feed paddle, a forward feed paddle and a residential or non-feed paddle and provide the resin under kneading with an elevated temperature due to its self-heat generation by setting the kneading machine temperature at a low level and kneading the resin under application of a high shearing force.

In order to simply raise the temperature of resin under kneading, it may be sufficient to increase the kneading machine set temperature, but in this case, it is difficult to apply a sufficient shearing force to the resin required for good material dispersion, so that it is difficult to achieve a uniform crosslinking in the kneading machine, thus being liable to result in fluctuation of crosslinking degree. Accordingly, an appropriate design of paddle organization is significant.

FIGS. 8–13 illustrate an organization of a twin-screw extruder as a preferred example of kneading machine suitably applicable in the melt-kneading step for producing the toner according to the present invention.

Figure 8:
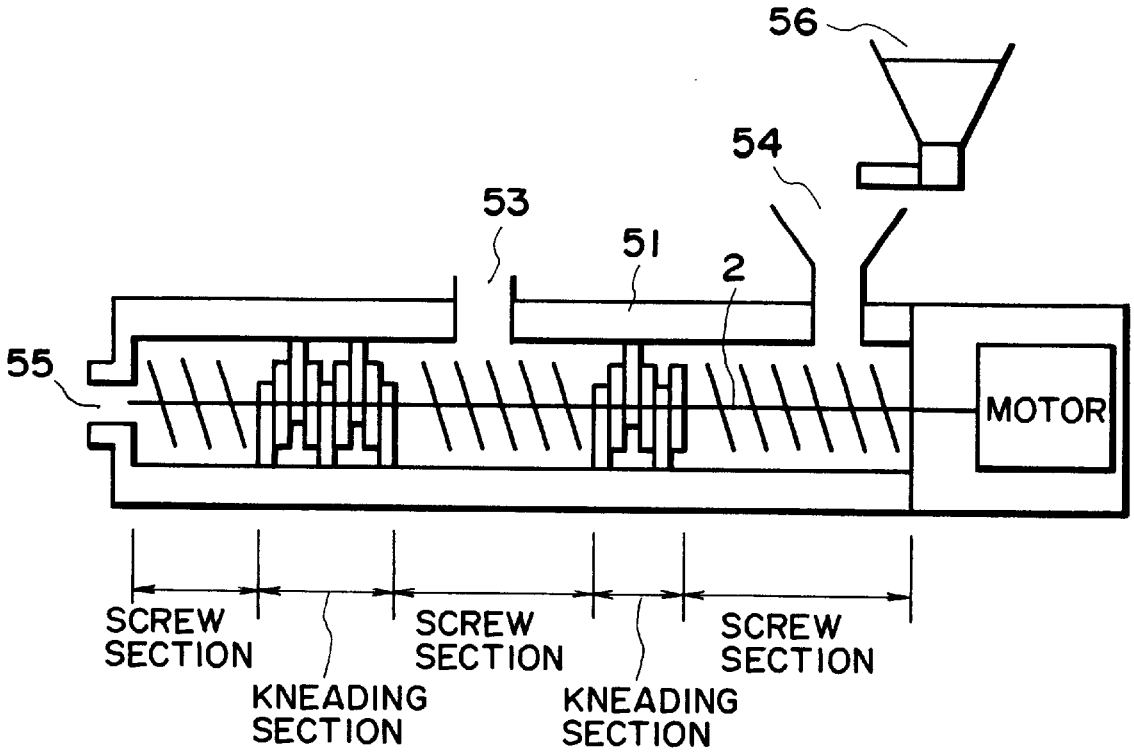
FIG. 8 is a schematic sectional illustration of a kneading machine suitable for use in production of a toner according to the invention.
Figure 9:
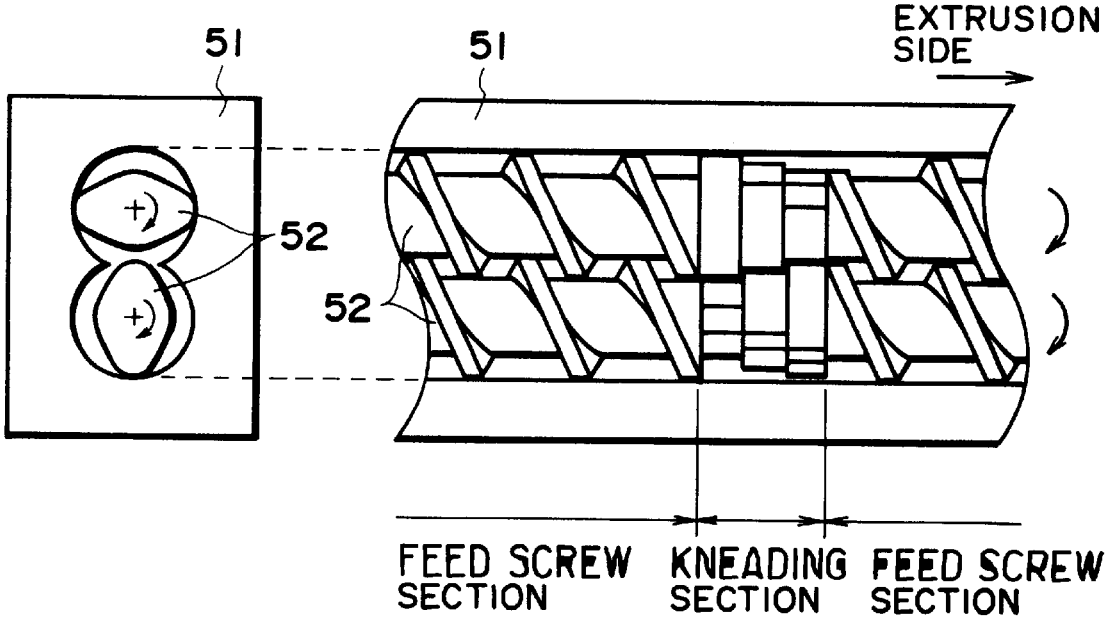
FIG. 9 is a detailed illustration of paddles in the kneading machine.
Figure 10:
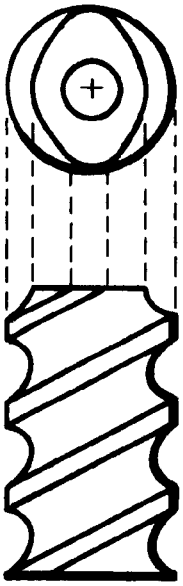
FIG. 10 illustrates a feed screw (S) in the screw section of the kneading machine.
Figure 11:
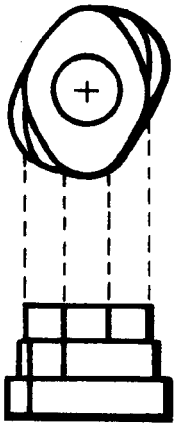
FIG. 11 illustrates a forward feed paddle (R) in the kneading section.
Figure 12:
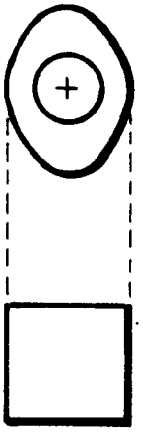
FIG. 12 illustrates a residential or non-feed paddle (W) in the kneading section.
Figure 13:
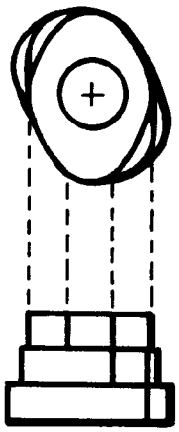
FIG. 13 illustrates a reverse feed paddle (L) in the kneading section.
Figure 14:
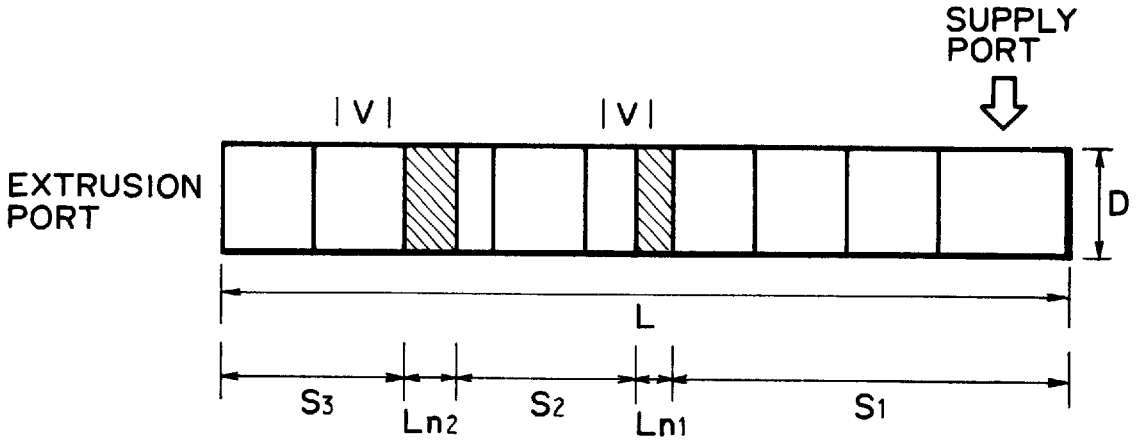
FIG. 14 illustrates a paddle arrangement of a kneading machine applicable to toner production in the present invention.

FIG. 8 is a schematic side sectional illustration of such a twin-screw extruder, and FIG. 9 is a detailed illustration of screws as viewed from the above of the extruder. Referring to these figures, the extruder includes two screw or paddle shafts 52 driven by a motor and enclosed within a heating cylinder 51 which is provided with a vent (hole) 53 and a supply port 54 disposed below a feed hopper 56, and an extrusion port 56. As shown in FIG. 8, each screw or paddle shaft is divided into pluralities of screw sections and kneading sections disposed alternately. Each screw section is constituted by a feed screw (S) as shown in FIG. 10, and each kneading section may be constituted by one or an appropriate combination of a forward feed paddle (R) (FIG. 11), a residential or no feed paddle (W) (FIG. 12) and a reverse feed paddle (L) (FIG. 13). Another screw or paddle shaft arrangement is illustraed in FIG. 14 in a simplified form.

Figure 15:
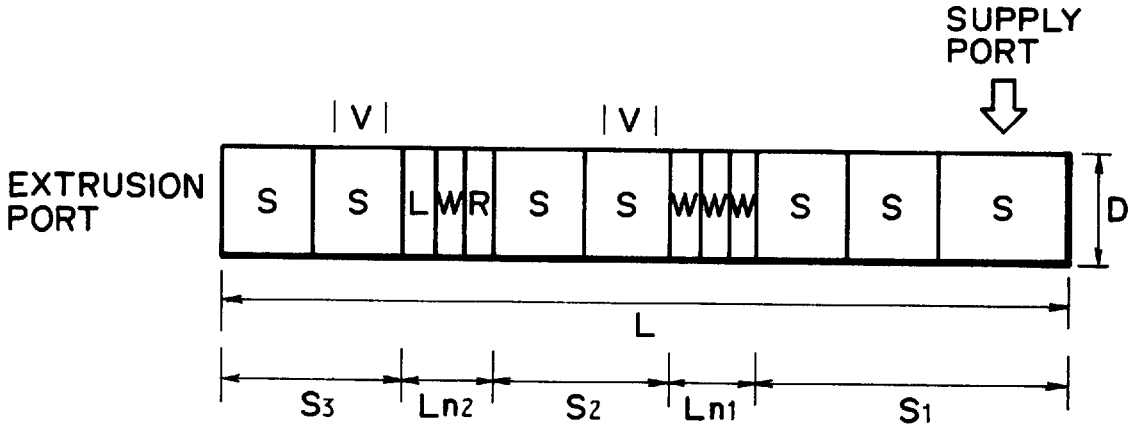
FIG. 15 illustrates a paddle organization of a kneading machine used in Example 1.
Figure 16:
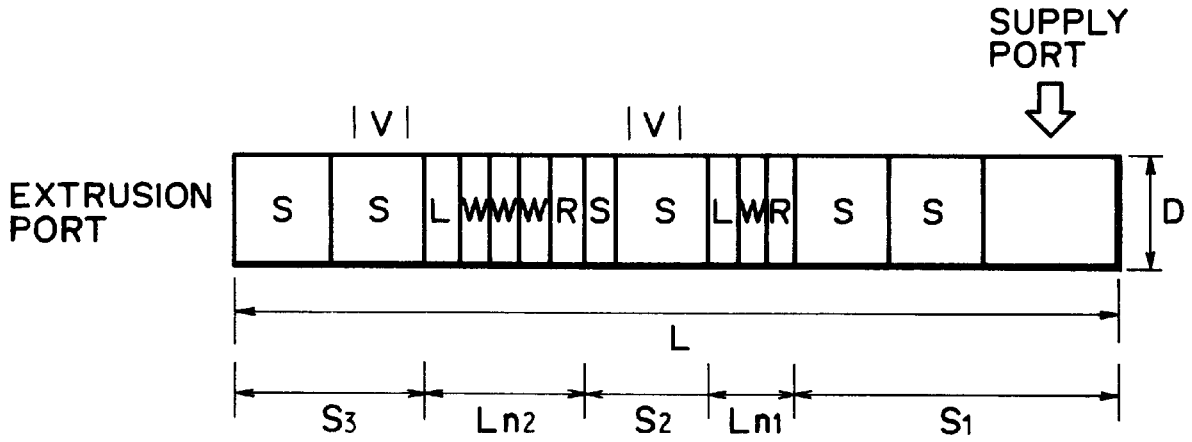
FIG. 16 illustrates a paddle organization of a kneading machine used in Example 15.

In preferred embodiments of such a twin-screw extruder, at least one kneading section is provided with a no-feed paddle (W) and/or a reverse feed paddle (L) in order to enhance the kneading action in a controlled manner. Examples of such a preferred embodiment are shown in FIGS. 15 and 16 in parallel with FIG. 14.

Now, an embodiment of the image forming method according to the present invention will be described with reference to FIGS. 4 and 5. The surface of an electrostatic image-bearing member (photosensitive member) 1 is charged to a negative potential or a positive potential by a primary charger 2 and exposed to image light 5 as by analog exposure or laser beam scanning to form an electrostatic image (e.g., a digital latent image as by laser beam scanning) on the photosensitive member. Then, the electrostatic image is developed with a magnetic toner 13 carried on a developing sleeve 4 according to a reversal development mode or a normal development mode. The toner 13 is initially supplied to a vessel of a developing device 9 and applied as a layer by a magnetic blade 11 on the developing sleeve 4 containing therein a magnet 23 having magnetic poles $N_1$, $N_2$, $S_1$ and $S_2$. At the development zone, a bias electric field is formed between the electroconductive substrate 16 of the photosensitive member 1 and the developing sleeve 4 by applying an alternating bias, a pulse bias and/or a DC bias voltage from a bias voltage application means 12 to the developing sleeve 4.

The magnetic toner image thus formed on the photosensitive member 1 is transferred via or without via an intermediate transfer member onto a recording material (recording paper) P. When recording paper P is conveyed to a transfer position, the back side (i.e., a side opposite to the photosensitive member) of the paper P is positively or negatively charged by a transfer charger 3 to electrostatically transfer the negatively or positively charged magnetic toner image on the photosensitive member 1 onto the recording paper P. Then, the recording paper P carrying the toner image is charge-removed by discharge means 22, separated from the photosensitive member 1 and subjected to heat-pressure fixation of the toner image by a hot pressure roller fixing device 7 containing therein heaters 21.

Residual magnetic toner remaining on the photosensitive member 1 after the transfer step is removed by a cleaning means comprising a cleaning blade 8. The photosensitive member 1 after the cleaning is charge-removed by erase exposure means 6 and then again subjected to an image forming cycle starting from the charging step by the primary charger 2.

Figure 5:
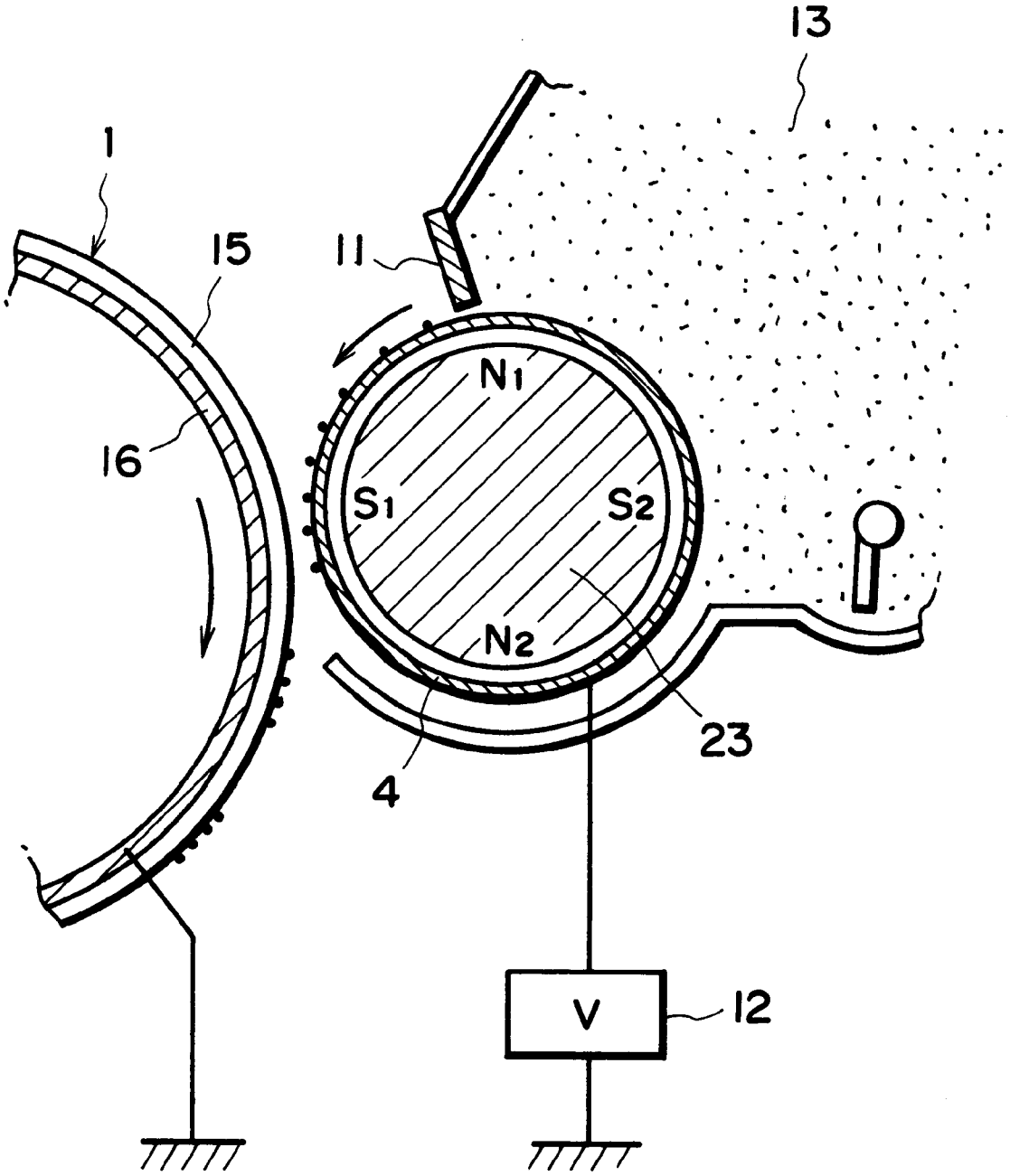
FIG. 5 shows an enlarged view of a developing section of the image forming apparatus shown in FIG. 4.

The electrostatic image bearing member or photosensitive member in the form of a drum 1 may comprise a photosensitive layer 15 formed on an electroconductive support 16 (FIG. 5). The non-magnetic cylindrical developing sleeve 4 is rotated so as to move in an identical direction as the photosensitive member 1 surface at the developing position. Inside the non-magnetic cylindrical developing sleeve 4, a multi-polar permanent magnet (magnet roll) 23 is disposed so as to be not rotated. The magnetic toner 13 in the developing device 9 is applied onto the developing sleeve 4 and provided with a triboelectric change due to friction between the developing sleeve 4 surface and the magnetic toner particles. Further, by disposing an iron-made magnetic blade 11 in proximity to (e.g., with a gap of 50–500 $\mu$m from) the developing sleeve 4 surface so as to be opposite to one magnetic pole of the multi-polar permanent magnet, the magnetic toner is controlled to be in a uniformly small thickness (e.g., 30–300 $\mu$m) that is identical to or smaller than the clearance between the photosensitive member 1 and the developing sleeve 4 at the developing position. The rotation speed of the developing sleeve 4 is controlled so as to provide a circumferential velocity identical or close to that of the photosensitive member 1 surface. The iron blade 11 as a magnetic doctor blade can be replaced by a permanent magnet so as to provide a counter magnetic pole. At the developing position, an AC bias or a pulse bias voltage may be applied to the developing sleeve 4 from a bias voltage application means 12. The AC bias voltage may preferably have a frequency f of 200–4,000 Hz and a peak-to-peak voltage Vpp of 500–3,000 volts.

Under the action of an electrostatic force on the photosensitive member surface and the AC bias or pulse bias electric field at the developing position, the magnetic toner particles are transferred onto an electrostatic image on the photosensitive member 1.

It is also possible to replace the magnetic blade with an elastic blade comprising an elastic material, such as silicone rubber, so as to apply a pressing force for applying a magnetic toner layer on the developing sleeve while regulating the magnetic toner layer thickness.

Because of the above-mentioned specific visco-elastic properties, the toner according to the present invention may exhibit particularly advantageous effects when used in a high speed machine having a process speed of preferably 200 mm/sec or larger.

In the image forming method according to the present invention, the photosensitive member may comprise amorphous silicon (a-Si), an organic photoconductor (OPC), selenium, or other inorganic photoconductors. In view of the stability of latent image potential during continuous image formation, it is preferred to use a-Si or OPC and is especially preferred to a-Si when used in a high-speed machine as described above requiring a severe durability of the photosensitive member.

Another image forming method to which the toner according to the present invention is applicable will now be described with reference to FIG. 6.

Figure 6:
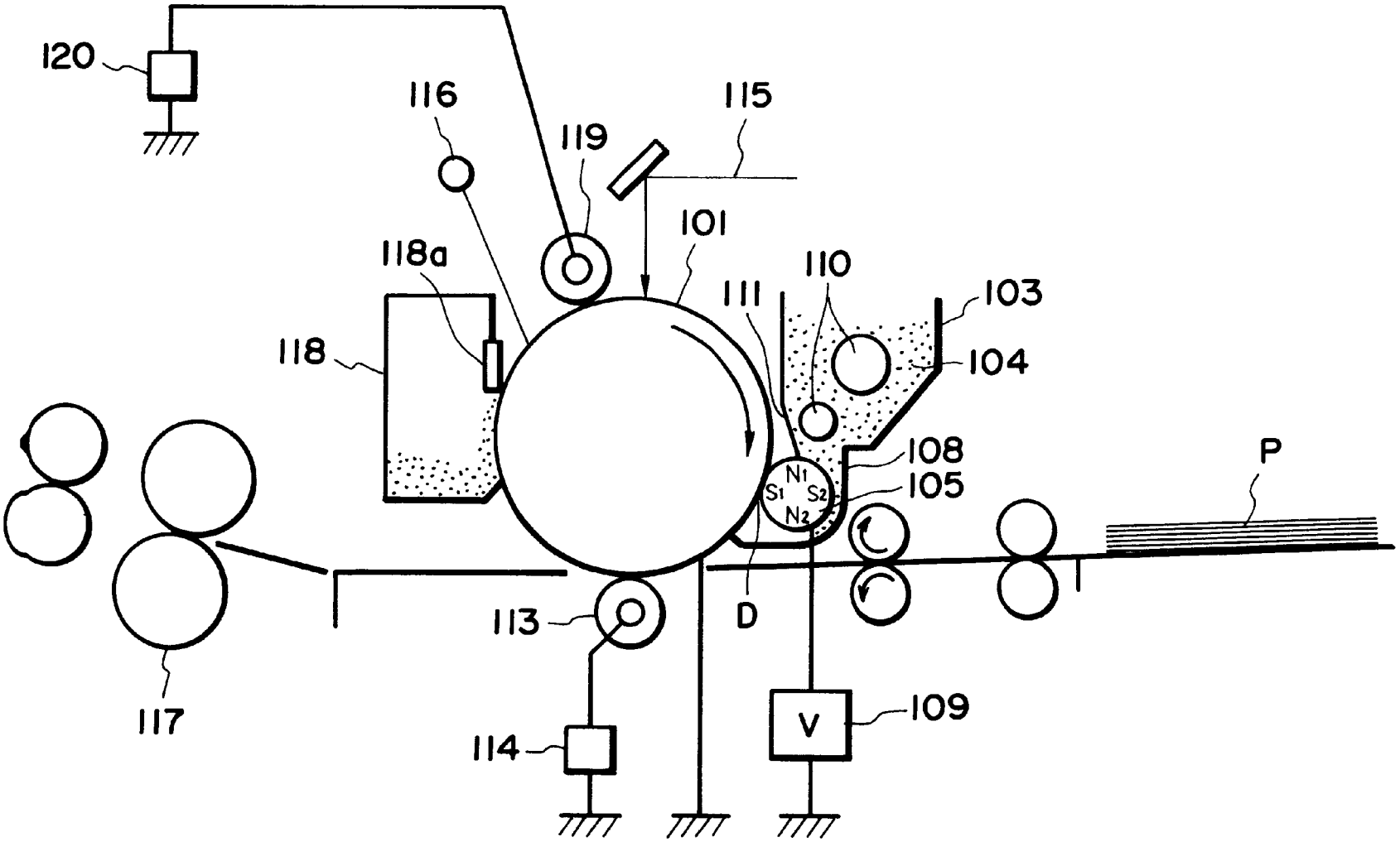
FIG. 6 illustrates an image forming apparatus capable of practicing another embodiment of the image forming method according to the invention.

Referring to FIG. 6, the surface of a photosensitive drum 101 as an electrostatic image-bearing member is charged to a negative polarity by a contact (roller) charging means 119 as a primary charging means and exposed to image scanning light 115 from a laser to form a digital electrostatic latent image on the photosensitive drum 101. The digital latent image is developed by a reversal development mode with a magnetic toner 104 held in a hopper 103 of a developing device equipped with a developing sleeve 108 (as a toner-carrying member) enclosing a multi-polar permanent magnet 105 and an elastic regulating blade 111 as a toner layer thickness-regulating member. As shown in FIG. 6, at a developing region D, an electroconductive substrate of the photosensitive drum 101 is grounded, and the developing sleeve 108 is supplied with an alternating bias, a pulse bias and/or a direct current bias from a bias voltage application means 109. When a recording material P is conveyed and arrives at a transfer position, a backside (opposite to the photosensitive drum) of the recording material P is charged by a contact (roller) transfer means 113 as a transfer means connected to a voltage application means 114, whereby the toner image formed on the photosensitive drum 101 is transferred onto the recording material P. The recording material P is then separated from the photosensitive drum 101 and conveyed to a hot pressure roller fixing device 117 as a fixing means, whereby the toner image is fixed onto the recording material A portion of the magnetic toner 104 remaining on the photosensitive drum 101 after the transfer step is removed by a cleaning means 118 having a cleaning blade 118*a*. If the amount of the residual toner is little, the cleaning step can be omitted. The photosensitive drum 101 after the cleaning is charge-removed by erasure exposure means 116, as desired, and further subjected a series of the above-mentioned steps starting with the charging step by the contact (roller) charging means 119 as a primary charging means.

In the above-mentioned series of steps, the photosensitive drum 101 (i.e., an electrostatic image-bearing member) comprises a photosensitive layer and an electroconductive substrate, and rotates in a direction of an indicated arrow. The developing sleeve 108 as a toner-carrying member in the form of a non-magnetic cylinder rotates so as to move in a direction to the surface-moving direction of the photosensitive drum 101 at the developing region D. Inside the developing sleeve 108, a multi-polar permanent magnet (magnet roll) 105 is disposed so as not to rotate. The magnetic toner 104 in the developer vessel 103 is applied onto the developing sleeve 108 and provided with a triboelectric charge of, e.g., negative polarity, due to friction with the developing sleeve 108 surface and/or other magnetic toner particles. Further, the elastic regulation blade 111 is elastically pressed against the developing sleeve 108 so as to regulate the toner layer in a uniformly small thickness (30–300 μm) that is smaller than a gap between the photosensitive drum 101 and the developing sleeve 108 in the developing region D. The rotation speed of the developing sleeve 108 is adjusted so as to provide a surface speed thereof that is substantially equal or close to the surface speed of the photosensitive drum 101. In the developing region D, the developing sleeve 108 may be supplied with a bias voltage comprising an AC bias, a pulse bias on an AC-DC superposed bias from the bias voltage application means 109. The AC bias may have f=200–4000 Hz and Vpp=500–3000 volts. At the developing region, the magnetic toner is transferred onto the electrostatic image side under the action of an electrostatic force on the photosensitive drum 101 surface and the developing bias voltage.

Figure 7:
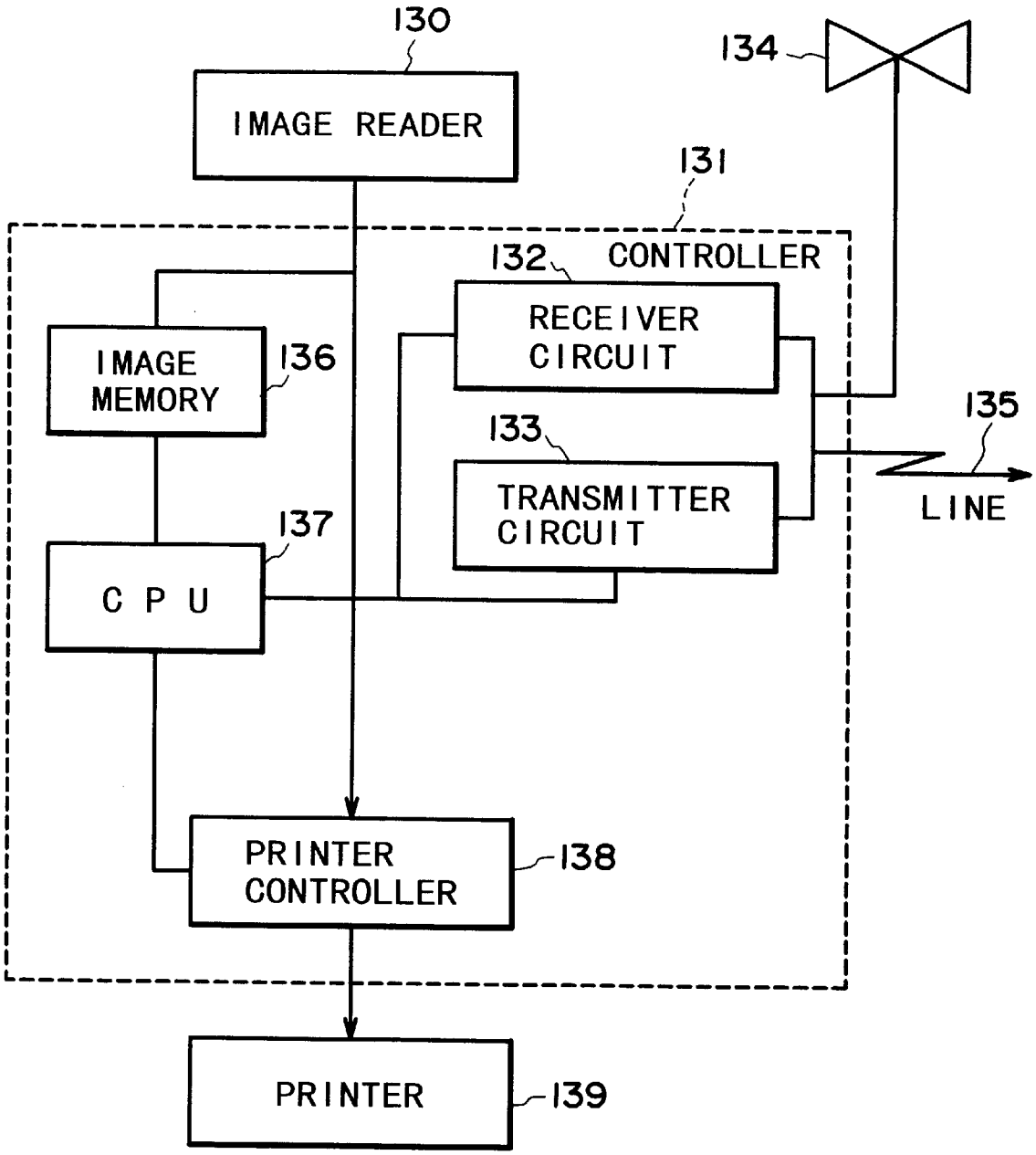
FIG. 7 is a block diagram of a facsimile apparatus including a printer to which an image forming method according to the invention is applicable.

In case where an image forming apparatus as described above is used as a printer for facsimile, the above-mentioned image exposure means corresponds to that for printing received data. FIG. 7 shows such an embodiment by using a block diagram.

Referring to FIG. 7, a controller 131 controls an image reader (or image reading unit) 130 and a printer 139. The entirety of the controller 131 is regulated by a CPU (central processing unit) 137. Read data from the image reader 130 is transmitted through a transmitter circuit 133 to another terminal such as facsimile. On the other hand, data received from another terminal such as facsimile is transmitted through a receiver circuit 132 to the printer 139. An image memory 136 stores prescribed image data. A printer controller 138 controls the printer 139. In FIG. 7, reference numeral 134 denotes a telephone set.

More specifically, an image received from a line (or circuit) 135 (i.e., image information received from a remote terminal connected by the line) is demodulated by means of the receiver circuit 132, decoded by the CPU 137, and sequentially stored in the image memory 136. When image data corresponding to at least one page is stored in the image memory 136, image recording is effected with respect to the corresponding page. The CPU 137 reads image data corresponding to one page from the image memory 136, and transmits the decoded data corresponding to one page to the printer controller 138. When the printer controller 138 receives the image data corresponding to one page from the CPU 137, the printer controller 138 controls the printer 139 so that image data recording corresponding to the page is effected. During the recording by the printer 139, the CPU 137 receives another image data corresponding to the next page.

Thus, receiving and recording of an image may be effected by means of the apparatus shown in FIG. 7 in the above-mentioned manner.

As described above, because of the specific visco-elastic properties, the toner according to the present invention is excellent in low-temperature fixability and anti-offset property and can be suitably used in a high-speed fixation system. If the THF-soluble content of the toner is set to have a specific molecular weight distribution, particularly with respect to contents of components in intermediate molecular weight regions, the fixability and anti-offset property as well as the fog-prevention performance of the toner can be further improved.

EXAMPLES

Hereinbelow, the present invention will be described more specifically based on Examples, which should not however be construed to limit the scope of the invention in any way.

Copolymer Synthesis Example 1

| | |
|---|---|
| Glycidyl acrylate | 20 wt. part(s) |
| Styrene | 70 " |
| n-Butylacrylate | 10 " |
| 2,2-Bis(4,4-di-t-butylperoxy-cyclohexyl)propane | 1.0 " |

The above ingredients were placed together with 300 wt. parts of xylene in a four-necked flask and subjected to 6 hours of reaction under xylene refluxing. After the reaction, the solvent was removed to obtain Copolymer (A) which exhibited a weight-average molecular weight (Mw) of $1.2\times10^4$ according to GPC measurement.

Copolymer Synthesis Example 2

| | |
|---|---|
| Glycidyl acrylate | 40 wt. part(s) |
| Styrene | 50 " |
| n-Butylacrylate | 10 " |
| 2,2-Bis(4,4-di-t-butylperoxy-cyclohexyl)propane | 1.0 " |

Copolymer (B) (Mw=$1.3\times10^4$) was prepared in the same manner as in Copolymer Synthesis Example 1 except for using the above ingredients.

Copolymer Synthesis Example 3

| | |
|---|---|
| Glycidyl acrylate | 10 wt. part(s) |
| Styrene | 80 " |
| n-Butyl acrylate | 10 " |
| 2,2-Bis(4,4-di-t-butylperoxy-cyclohexyl)propane | 1.0 " |

Copolymer (C) (Mw=$1.1\times10^4$) was prepared in the same manner as in Copolymer Synthesis Example 1 except for using the above ingredients.

Copolymer Synthesis Example 4

| | |
|---|---|
| Styrene | 63 wt. part(s) |
| n-Butyl acrylate | 25 " |
| Monobutyl maleate | 12 " |
| Di-tertbutyl peroxide | 1.5 " |

200 wt. parts of xylene was placed in a four-necked flask and, after sufficient aeration with nitrogen, heated to its reflux temperature under stirring. Into the flask containing the xylene under refluxing, the above ingredients were added dropwise in 4 hours, and thereafter the polymerization was completed under xylene refluxing, followed by solvent removal, to obtain Copolymer (D) (Mw=3500).

Copolymer Synthesis Example 5

| | |
|---|---|
| Styrene | 69 wt. part(s) |
| n-Butyl acrylate | 25 " |
| Methacrylic acid | 6 " |
| Di-tertbutyl peroxide | 1.5 " |

200 wt. parts of xylene was placed in a four-necked flask and, after sufficient aeration with nitrogen, heated to its reflux temperature under stirring. Into the flask containing the xylene under refluxing, the above ingredients were added dropwise in 4 hours, and thereafter the polymerization was completed under xylene refluxing, followed by solvent removal, to obtain Copolymer (E) (Mw=3800).

Binder Synthesis Example 1

| | |
|---|---|
| Styrene | 84 wt. part(s) |
| n-Butyl acrylate | 16 " |
| Di-tert-butyl peroxide | 2 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 6 wt. parts of Copolymer (A) and 28 wt. parts of Copolymer (D) were added to the reaction mixture, followed by dissolution, stirring to effect crosslinking under xylene refluxing and solvent removal to recover Binder resin 1.

Binder Synthesis Example 2

| | |
|---|---|
| Styrene | 84 wt. part(s) |
| n-Butyl acrylate | 16 " |
| Di-tert-butyl peroxide | 1.8 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 6 wt. parts of Copolymer (A) and 28 wt. parts of Copolymer (D) were added to the reaction mixture, followed by dissolution, stirring to effect crosslinking under xylene refluxing and solvent removal to recover Binder resin 2.

Binder Synthesis Example 3

| | |
|---|---|
| Styrene | 84 wt. part(s) |
| n-Butyl acrylate | 16 " |
| Di-tert-butyl peroxide | 2.2 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 8 wt. parts of Copolymer (A) and 35 wt. parts of Copolymer (D) were added to the reaction mixture, followed by dissolution, stirring to effect crosslinking under xylene refluxing and solvent removal to recover Binder resin 3.

Binder Synthesis Example 4

| | |
|---|---|
| Styrene | 84 wt. part(s) |
| n-Butyl acrylate | 16 " |
| Di-tert-butyl peroxide | 2.3 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 5 wt. parts of Copolymer (C) and 20 wt. parts of Copolymer (E) were added to the reaction mixture, followed by dissolution, stirring to effect crosslinking under xylene refluxing and solvent removal to recover Binder resin 4.

Binder Synthesis Example 5

| | |
|---|---|
| Styrene | 84 wt. part(s) |
| n-Butyl acrylate | 16 " |
| Di-tert-butyl peroxide | 1.6 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 8 wt. parts of Copolymer (A) and 35 wt. parts of Copolymer (D) were added to the reaction mixture, followed by dissolution, stirring to effect crosslinking under xylene refluxing and solvent removal to recover Binder resin 5.

Binder Synthesis Example 6

| | |
|---|---|
| Styrene | 84 wt. part(s) |
| n-Butyl acrylate | 16 " |
| Di-tert-butyl peroxide | 3 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 5 wt. parts of Copolymer (A) and 20 wt. parts of Copolymer (D) were added to the reaction mixture, followed by dissolution, stirring to effect crosslinking under xylene refluxing and solvent removal to recover Binder resin 6.

Binder Synthesis Example 7

| | |
|---|---|
| Styrene | 86 wt. part(s) |
| n-Butyl acrylate | 14 " |
| Di-tert-butyl peroxide | 1 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 6 wt. parts of Copolymer (A) and 28 wt. parts of Copolymer (D) were added to the reaction mixture, followed by dissolution, stirring to effect crosslinking under xylene refluxing and solvent removal to recover Binder resin 7.

Binder Synthesis Example 8

| | |
|---|---|
| Styrene | 84 wt. part(s) |
| n-Butyl acrylate | 16 " |
| Di-tert-butyl peroxide | 2.7 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 6 wt. parts of Copolymer (A) and 28 wt. parts of Copolymer (D) were added to the reaction mixture, followed by dissolution, stirring to effect crosslinking under xylene refluxing and solvent removal to recover Binder resin 8.

Binder Synthesis Example 9

| | |
|---|---|
| Styrene | 84 wt. part(s) |
| n-Butyl acrylate | 16 " |
| Di-tert-butyl peroxide | 2.8 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 8 wt. parts of Copolymer (C) and 35 wt. parts of Copolymer (D) were added to the reaction mixture, followed by dissolution, stirring to effect crosslinking under xylene refluxing and solvent removal to recover Binder resin 9.

Binder Synthesis Example 10

| | |
|---|---|
| Styrene | 84 wt. part(s) |
| n-Butyl acrylate | 16 " |
| Di-tert-butyl peroxide | 1.2 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 5 wt. parts of Copolymer (B) and 20 wt. parts of Copolymer (D) were added to the reaction mixture, followed by dissolution, stirring to effect crosslinking under xylene refluxing and solvent removal to recover Binder resin 10.

Binder Synthesis Example 11

| | |
|---|---|
| Styrene | 84 wt. part(s) |
| n-Butyl acrylate | 16 " |
| Di-tert-butyl peroxide | 2.7 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 5 wt. parts of Copolymer (C) and 20 wt. parts of Copolymer (E) were added to the reaction mixture, followed by dissolution, stirring to effect crosslinking under xylene refluxing and solvent removal to recover Binder resin 11.

Binder Synthesis Example 12

| | |
|---|---|
| Styrene | 84 wt. part(s) |
| n-Butyl acrylate | 16 " |
| Di-tert-butyl peroxide | 1.5 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 6.5 wt. part of divinylbenzene, 5 wt. parts of Copolymer (A) and 28 wt. parts of Copolymer (D) were added to the reaction mixture, followed by dissolution, stirring to effect crosslinking under xylene refluxing and solvent removal to recover Binder resin 12.

Binder Synthesis Example 13

| | |
|---|---|
| Styrene | 84 wt. part(s) |
| n-Butyl acrylate | 16 " |
| Di-tert-butyl peroxide | 2 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 6 wt. parts of Copolymer (C) and 35 wt. parts of Copolymer (D) were added to the reaction mixture, followed by dissolution, stirring to effect crosslinking under xylene refluxing and solvent removal to recover Binder resin 13.

Binder Synthesis Example 14

| | |
|---|---|
| Styrene | 84 wt. part(s) |
| n-Butyl acrylate | 16 " |
| Di-tert-butyl peroxide | 2.4 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 10 wt. parts of Copolymer (A) and 22 wt. parts of Copolymer (D) were added to the reaction mixture, followed by dissolution, stirring to effect crosslinking under xylene refluxing and solvent removal to recover Binder resin 14.

Binder Synthesis Example 15

| | |
|---|---|
| Styrene | 84 wt. part(s) |
| n-Butyl acrylate | 16 " |
| Di-tert-butyl peroxide | 2.4 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 6 wt. parts of Copolymer (A) and 28 wt. parts of Copolymer (D) were added to the reaction mixture, followed by dissolution, stirring to effect crosslinking under xylene refluxing and solvent removal to recover Binder resin 15.

Binder Synthesis Example 16

| | |
|---|---|
| Styrene | 84 wt. part(s) |
| n-Butyl acrylate | 16 " |
| Di-tert-butyl peroxide | 1.3 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 12 wt. parts of Copolymer (C) and 28 wt. parts of Copolymer (D) were added to the reaction mixture, followed by dissolution, stirring to effect crosslinking under xylene refluxing and solvent removal to recover Binder resin 16.

Binder Synthesis Example 17

| | |
|---|---|
| Styrene | 84 wt. part(s) |
| n-Butyl acrylate | 16 " |
| Di-tert-butyl peroxide | 4 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 5 wt. parts of Copolymer (C) and 35 wt. parts of Copolymer (E) were added to the reaction mixture, followed by dissolution, stirring to effect crosslinking under xylene refluxing and solvent removal to recover Binder resin 17.

Binder Synthesis Example 18

| | |
|---|---|
| Styrene | 84 wt. part(s) |
| n-Butyl acrylate | 16 " |
| Di-tert-butyl peroxide | 0.5 " |
| Divinylbenzene | 0.5 " |

The above ingredients were added dropwise into 200 wt. parts of water containing 0.2 wt. part of incompletely saponified polyvinyl alcohol under vigorous stirring to form a suspension liquid. The system was then subjected to 8 hours of suspension polymerization at 80° C. After the reaction, the polymerizate was washed with water, de-watered and dried to recover Binder resin 18.

Binder Synthesis Example 19

| | |
|---|---|
| Styrene | 84 wt. part(s) |
| n-Butyl acrylate | 16 " |
| Di-tert-butyl peroxide | 4 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 2 wt. parts of Copolymer (C) and 20 wt. parts of Copolymer (D) were added to the reaction mixture, followed by dissolution, stirring to effect crosslinking under xylene refluxing and solvent removal to recover Binder resin 19.

Binder Synthesis Example 20

| | |
|---|---|
| Styrene | 84 wt. part(s) |
| n-Butyl acrylate | 16 " |
| Di-tert-butyl peroxide | 0.7 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 8 wt. parts of Copolymer (B) and 35 wt. parts of Copolymer (D) were added to the reaction mixture, followed by dissolution, stirring to effect crosslinking under xylene refluxing and solvent removal to recover Binder resin 20.

Binder Synthesis Example 21

| | |
|---|---|
| Styrene | 84 wt. part(s) |
| n-Butyl acrylate | 16 " |
| Di-tert-butyl peroxide | 2 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 10 wt. parts of Copolymer (B) and 44 wt. parts of Copolymer (D) were added to the reaction mixture, followed by dissolution, stirring to effect crosslinking under xylene refluxing and solvent removal to recover Binder resin 21.

Binder Synthesis Example 22

| | |
|---|---|
| Styrene | 84 wt. part(s) |
| n-Butyl acrylate | 16 " |
| Di-tert-butyl peroxide | 3 " |

The above ingredients were added dropwise in 4 hours to 300 wt. parts of xylene under stirring which had been placed in a four-necked flask, sufficiently aerated with nitrogen and heated to refluxing, followed by 2 hours of reaction to complete the polymerization. Then, 3 wt. parts of Copolymer (A) and 15 wt. parts of Copolymer (D) were added to the reaction mixture, followed by dissolution, stirring to effect crosslinking under xylene refluxing and solvent removal to recover Binder resin 22.

Binder Synthesis Example 23

| | |
|---|---|
| Copolymer (D) | 30 wt. part(s) |
| Styrene | 45.65 " |
| n-Butyl acrylate | 20 " |
| Monobutyl maleate | 4.0 " |
| Divinylbenzene | 0.35 " |
| Benzoyl peroxide | 1.0 " |
| Di-t-butylperoxy-2-ethylhexanoate | 0.5 " |

The above ingredients were added dropwise into 200 wt. parts of water containing 0.2 wt. part of incompletely saponified polyvinyl alcohol under vigorous stirring to form a suspension liquid. The system was then subjected to 8 hours of suspension polymerization at 80° C. After the reaction, the polymerizate was washed with water, de-watered and dried to recover Binder resin 23.

Example 1

| | |
|---|---|
| Binder resin 1 | 100 wt. part(s) |
| Triiron tetroxide 1 | 90 " |
| (number-average particle size (Dn) = 0.2 $\mu$m, Hc = 8.2 kA/m, $\sigma_s$ = 86.5 $Am^2/kg$, $\sigma_r$ = 9.1 $Am^2/kg$) | |
| Triphenylmethane lake pigment | 2 " |
| Salicylic acid aluminum complex | 0.5 " |
| Polyethylene wax 1 | 6 " |
| (melting point (Tmp) = 77° C., melt-viscosity at 160° C. ($V_{160°\ C.}$) = 8 mPa.sec) | |

Figure 2:
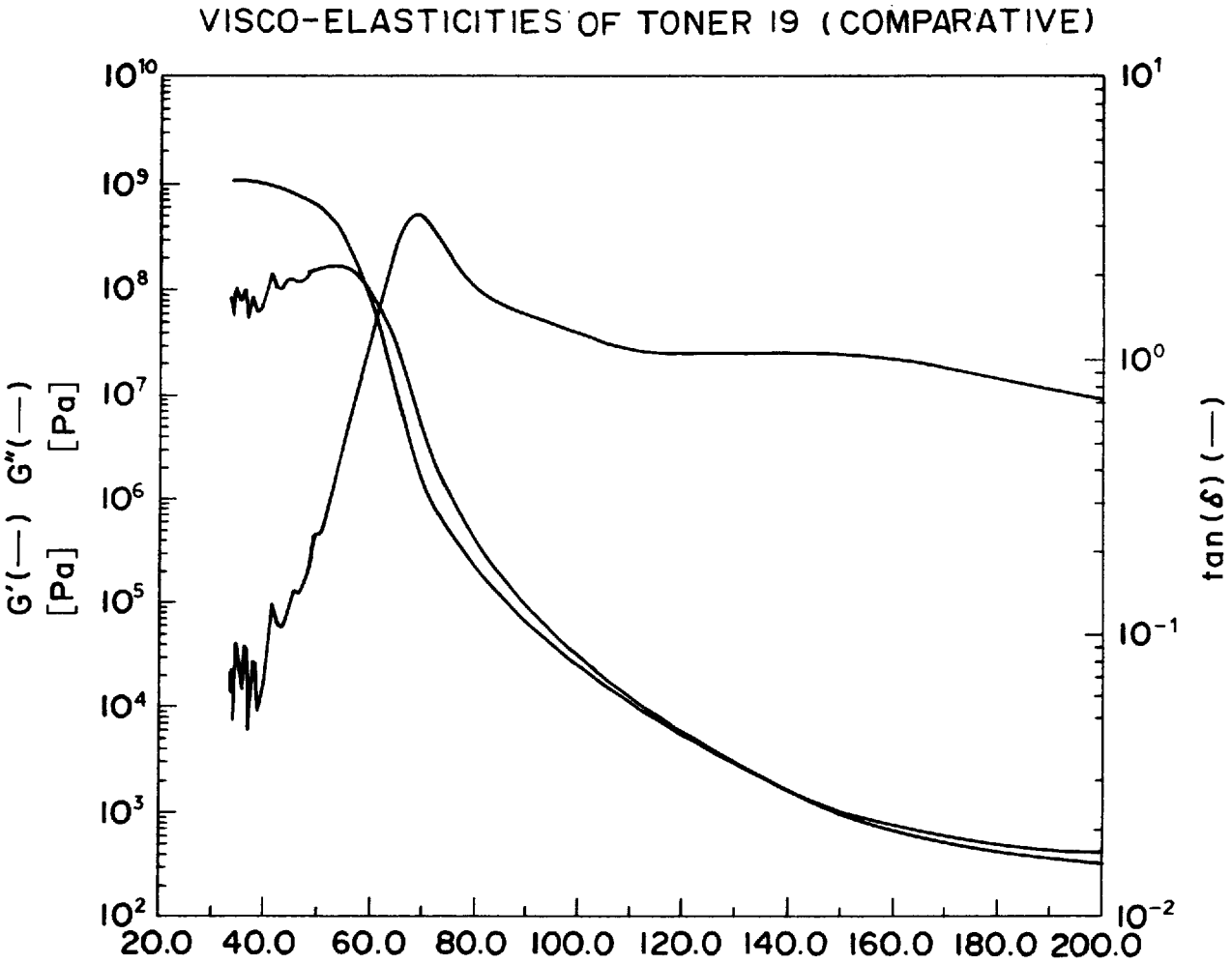
FIG. 2 is a graph showing visco-elastic properties of a comparative toner.
Figure 3:
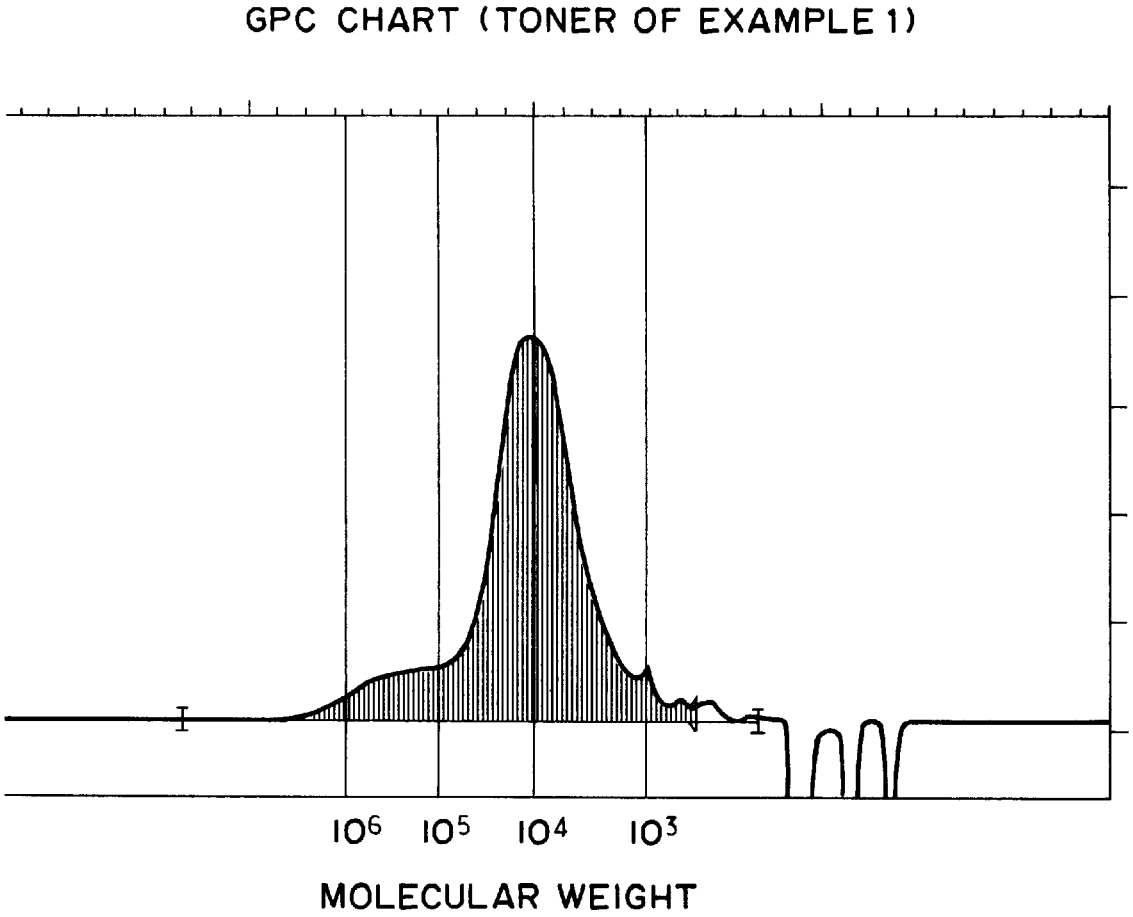
FIG. 3 is a GPC chromatogram for a THF-soluble content of a toner according to the invention.

The above ingredients were preliminarily blended and then melt-kneaded through a twin screw extruder having a paddle organization as shown in FIG. 15 including kneading sections (Ln1 and Ln2) provided with non-feed paddles (W) and a reverse feed paddle (L) in addition to a forward feed paddle (R) and having a set cylinder temperature of 150° C. The thus-kneaded product was cooled, coarsely crushed by a cutter mill and then finely pulverized by a pulverizer using a jet air stream, followed by classification by a pneumatic classifier to obtain black fine powder (Toner 1) having a weight-average particle size (D4) of 7.0 $\mu$m. The visco-elastic properties, GPC molecular weight distribution and some other properties (including THF-insoluble content ($THF_{ins}$ (wt. %)) and weight-average particle size (D4)) of Toner 1 are shown in Table 1 together with those of other toners prepared in the following Examples. Graphs showing visco-elastic properties and a GPC chromatogram of Toner 1 are shown in FIGS. 1 and 2, respectively.

100 wt. parts of Toner 1 prepared above was externally blended with 0.8 wt. part of positively chargeable hydrophobic colloidal silica fine powder A (BET specific surface area (SBET)=95 $m^2/g$) to prepare positively chargeable Magnetic toner 1 carrying the colloidal silica fine powder on the surface of toner particles. Magnetic toner 1 was then subjected to tests for evaluating low-temperature fixability, anti-offset property, fixing roller soiling, anti-blocking property and developing performance.

As a result, Magnetic toner 1 exhibited good low-temperature fixability and anti-offset property, and was free from causing the winding of fixation sheet about the fixing roller or traces of separation claws in the resultant fixed images. The resultant images exhibited a good fog-free level at the initial stage and on a 50000-th sheet of continuous image formation. No problem was observed regarding the anti-blocking property or tone melt-sticking onto the photosensitive member. The results of evaluation are summarized in Table 2 appearing hereinafter together with those of other toners prepared and evaluated in the following Examples.

The details of the evaluation tests are as follows.

Test Machine

Figure 4:
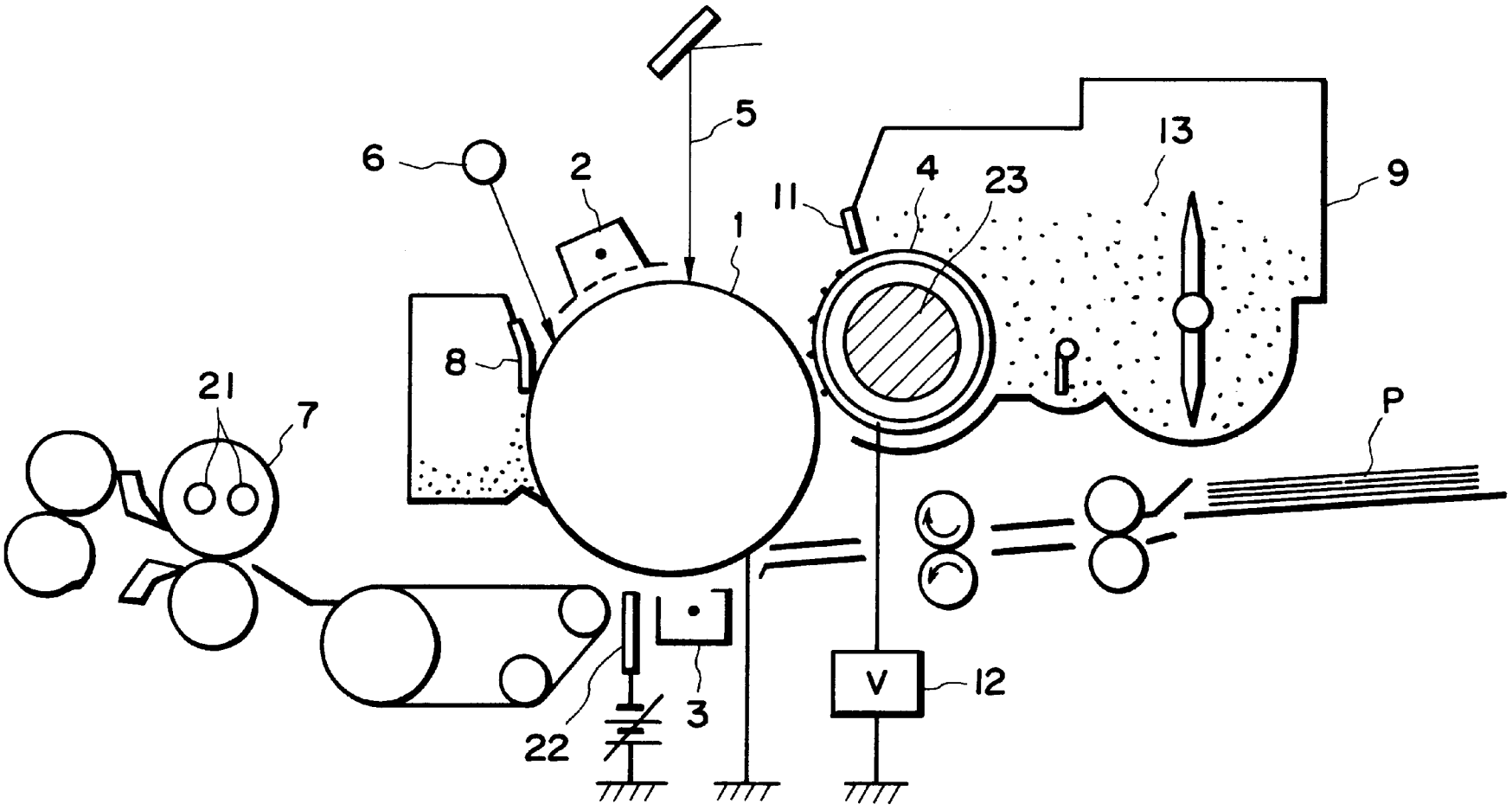
FIG. 4 illustrates an image forming apparatus capable of practicing an embodiment of the image forming method according to the invention.

A commercially available electrophotographic copying machine having a structure as shown in FIG. 4 and equipped with a fixing roller surfaced with a polytetrafluoroethylene (PTFE) resin layer ("NP6750", mfd. by Canon K.K.) was remodeled by using a negatively chargeable a-Si photosensitive drum and bias power supply adapted therefor so as to allow the use of a positively chargeable toner.

Fixing Performances

The fixing device of the above-remodeled test device was taken out to provide a heating roller-type external fixing device allowing variable fixing temperatures, which was used to effect the low-temperature fixability and anti-offset property tests.

The external fixing device was set to provide a nip of 8.5 mm and a process speed of 400 mm/sec. The fixing temperatures were set in the range of 100–245° C. at increments of 5° C. each, and fixed images at the respective temperatures were rubbed with a lens cleaning paper at a load of 50 $g/cm^2$ to determine the lowest fixing temperature giving an image density lowering of at most 10% as a fixing initiation temperature ($T_{FI}$). Further, as the fixing temperature was increased, the lowest temperature free from offset was determined as a low-temperature offset-free (initial) point ($T_{offset.min}$) and the highest temperature free from offset was determined as a high-temperature offset-free (end) point ($T_{offset.max}$).

Developing Performance, Toner Melt-Sticking, Antifixing Roller Winding and Separation Claw Trace A continuous image formation on 50,000 sheets was performed by using ca. 300 g of a toner charged in the above-mentioned test machine (remodeled "NP6750") to evaluate image fog at the initial stage and on the 50,000-th sheet, and melt-sticking onto the photosensitive member, and winding of fixing sheet about the fixing roller and separation claw traces on solid black image when reproducing such solid black images after the continuous image formation on 50,000 sheets.

Fog was determined as a difference between the whitenesses of a blank white recording paper and the white recording paper on which a solid white image was formed based on whiteness values measured by a reflectometer (available from Tokyo Denshoku K.K.).

The melt-sticking on the photosensitive member was evaluated with eyes according to the following standard.

A: No toner melt-sticking was observed at all on the photosensitive member.

B: Slight toner melt-sticking was observed on the photosensitive member but was not recognized on the resultant images.

C: White spot-like image dropouts were observed in solid black images.

D: Image dropouts in the form of spots to shooting stars were observed on solid black images.

Winding about the fixing roller and the separation claw trace were evaluated by reproducing a wholly solid black image on A4-size paper sheets except for a leading white margin width of 4.5 mm-according to the following standards.

Winding About the Fixing Roller

A: Recording sheets after the fixation were smoothly discharged.

B: Recording sheets after the fixation were discharged without problem while relying on the separation claws.

C: Recording sheets after the fixation and discharge were accompanied with twist.

D: Recording sheets after the fixation caused paper jamming.

Separation Claw Trace

A: No separation claw trace was observed at all on the fixed (solid black) images.

B: The fixed images were accompanied with 1–2 slight trace lines of separation claws.

C: The fixed images were accompanied with 3–4 slight trace lines of separation claws.

D: The fixed images were accompanied with 5–6 clear trace lines of separation claws.

Fixing Roller Soiling

An image formation test similar to the one performed for evaluating the toner-melt-sticking was performed on 50,000 sheets by reproducing a lattice pattern including a combination of longitudinal and transverse lines each in a width of 0.2 mm and drawn in a density of 2 lines/cm. Thereafter, the toner attachment on the fixing roller and the influence thereof for causing while dropout on solid black images were observed to allow an evaluation according to the following standard.

A: No soiling was observed at all on the fixing roller.

B: Slight lines of attached toner were observed on the fixing roller but no influence thereof was observed on the resultant images.

C: White dropout lines were observed in the solid black images at a rate of about 1 line per 5 cm-width.

D: White dropout lines were observed in the solid black images at a rate corresponding to that on the original lattice image.

Anti-Blocking Property

Ca. 10 g of a toner sample was placed in a 100 cc-plastic cup and left standing at 50° C. for 3 days. The state of the toner was thereafter evaluated with eyes.

A: No agglomerate was observed.

B: Some agglomerate was observed but readily collapsed.

C: Some agglomerate was observed but was collapsed by shaking.

D: Agglomerate could be gripped and was not collapsed readily.

Example 2

| | |
|---|---|
| Binder resin 2 | 100 wt. part(s) |
| Triiron tetroxide 1 | 90 " |
| Monoazo metal complex | 2 " |
| Salicylic acid aluminum complex | 0.5 " |
| Polyethylene wax 2 | 6 " |
| (Tmp = 150° C., V (160° C.) = 15 mPa.s) | |

Black fine powder (Toner 2) (D4=7.2 μm) having properties shown in Table 1 was prepared from the above ingredients otherwise in the same manner as in Example 1.

100 wt. parts of Toner 2 prepared above was externally blended with 0.8 wt. part of negatively chargeable hydrophobic colloidal silica fine powder B ($S_{BET}$=160 m/g) to prepare negatively chargeable Magnetic toner 2, which was evaluated with respect to items identical to those evaluated in Example 1 by using the commercially available electrophotographic copying apparatus having a structure as shown in FIG. 4 and adapted for using a negatively chargeable toner ("NP6750", mfd. by Canon K.K.) without the remodeling with respect to the photosensitive member or the bias power supply. The results and are shown in Table 2 together with those obtained in the following Examples.

Example 3

| | |
|---|---|
| Binder resin 3 | 100 wt. part(s) |
| Triiron tetroxide 1 | 90 " |
| Triphenylmethane lake pigment | 2 " |
| Salicylic acid aluminum complex | 0.5 " |
| Polyethylene wax 3 | 6 " |
| (Tmp = 85° C., V (160° C.) = 9 mPa.s) | |

Black fine powder (Toner 3) (D4=6.8 μm) was prepared from the above ingredients otherwise in the same manner as in Example 1.

100 wt. parts of Toner 3 was externally blended with 0.8 wt. part of positively chargeable colloidal silica A to form positively chargeable Magnetic toner 3, which was evaluated in the same manner as in Example 1.

Example 4

| | |
|---|---|
| Binder resin 4 | 100 wt. part(s) |
| Triiron tetroxide 1 | 90 " |
| Triphenylmethane lake pigment | 2 " |
| Salicylic acid aluminum complex | 0.5 " |
| Polyethylene wax 1 | 6 " |

Black fine powder (Toner 4) (D4=6.9 μm) was prepared from the above ingredients otherwise in the same manner as in Example 1.

100 wt. parts of Toner 4 was externally blended with 0.8 wt. part of positively chargeable colloidal silica A to form positively chargeable Magnetic toner 4, which was evaluated in the same manner as in Example 1.

Example 5

| | |
|---|---|
| Binder resin 5 | 100 wt. part(s) |
| Triiron tetroxide 1 | 90 " |
| Triphenylmethane lake pigment | 2 " |
| Acetylacetone iron complex | 0.5 " |
| Polyethylene wax 1 | 6 " |

Black fine powder (Toner 5) (D4=7.0 μm) was prepared from the above ingredients otherwise in the same manner as in Example 1.

100 wt. parts of Toner 5 was externally blended with 0.8 wt. part of positively chargeable colloidal silica A to form positively chargeable Magnetic toner 5, which was evaluated in the same manner as in Example 1.

Example 6

| | |
|---|---|
| Binder resin 6 | 100 wt. part(s) |
| Triiron tetroxide 1 | 90 " |
| Triphenylmethane lake pigment | 2 " |
| Salicylic acid aluminum complex | 0.5 " |
| Polypropylene wax 4 | 6 " |
| (Tmp = 135° C., V (160° C.) = 215 mPa.s) | |

Black fine powder (Toner 6) (D4=6.8 μm) was prepared from the above ingredients otherwise in the same manner as in Example 1.

100 wt. parts of Toner 6 was externally blended with 0.8 wt. part of positively chargeable colloidal silica A to form positively chargeable Magnetic toner 6, which was evaluated in the same manner as in Example 1.

Example 7

| | |
|---|---|
| Binder resin 7 | 100 wt. part(s) |
| Triiron tetroxide 1 | 90 " |
| Triphenylmethane lake pigment | 2 " |
| Acetylacetone iron complex | 0.7 " |
| Polyethylene wax 1 | 6 " |

Black fine powder (Toner 7) (D4=7.1 μm) was prepared from the above ingredients otherwise in the same manner as in Example 1.

100 wt. parts of Toner 7 was externally blended with 0.8 wt. part of positively chargeable colloidal silica A to form positively chargeable Magnetic toner 7, which was evaluated in the same manner as in Example 1.

Example 8

| | |
|---|---|
| Binder resin 8 | 100 wt. part(s |
| Triiron tetroxide 1 | 90 " |
| Triphenylmethane lake pigment | 2 " |
| Acetylacetone iron complex | 0.5 " |
| Polyethylene wax 1 | 6 " |

Black fine powder (Toner 8) (D4=7.0 μm) was prepared from the above ingredients otherwise in the same manner as in Example 1.

100 wt. parts of Toner 8 was externally blended with 0.8 wt. part of positively chargeable colloidal silica A to form positively chargeable Magnetic toner 8, which was evaluated in the same manner as in Example 1.

Example 9

| | |
|---|---|
| Binder resin 9 | 100 wt. part(s) |
| Triiron tetroxide 1 | 90 " |
| Triphenylmethane lake pigment | 2 " |
| Acetylacetone iron complex | 0.1 " |
| Polyethylene wax 3 | 6 " |

Black fine powder (Toner 9) (D4=6.8 μm) was prepared from the above ingredients otherwise in the same manner as in Example 1.

100 wt. parts of Toner 9 was externally blended with 0.8 wt. part of positively chargeable colloidal silica A to form positively chargeable Magnetic toner 9, which was evaluated in the same manner as in Example 1.

Example 10

| | |
|---|---|
| Binder resin 19 | 100 wt. part(s) |
| Triiron tetroxide 1 | 90 " |
| Triphenylmethane lake pigment | 2 " |
| Salicylic acid aluminum complex | 1.0 " |
| Polyethylene wax 5 | 6 " |
| (Tmp = 74° C., V (160° C.) = 7 mPa.s) | |

Black fine powder (Toner 10) (D4=7.2 μm) was prepared from the above ingredients otherwise in the same manner as in Example 1.

100 wt. parts of Toner 10 was externally blended with 0.8 wt. part of positively chargeable colloidal silica A to form positively chargeable Magnetic toner 10, which was evaluated in the same manner as in Example 1.

Example 11

| | |
|---|---|
| Binder resin 11 | 100 wt. part(s) |
| Triiron tetroxide 1 | 90 " |
| Triphenylmethane lake pigment | 2 " |
| Salicylic acid aluminum complex | 0.3 " |
| Polypropylene wax 4 | 6 " |

Black fine powder (Toner 11) (D4=7.1 μm) was prepared from the above ingredients otherwise in the same manner as in Example 1.

100 wt. parts of Toner 11 was externally blended with 0.8 wt. part of positively chargeable colloidal silica A to form positively chargeable Magnetic toner 11, which was evaluated in the same manner as in Example 1.

Example 12

| | |
|---|---|
| Binder resin 12 | 100 wt. part(s) |
| Triiron tetroxide 1 | 90 " |
| Triphenylmethane lake pigment | 2 " |
| Salicylic acid aluminum complex | 0.7 " |
| polyethylene wax 1 | 6 " |

Black fine powder (Toner 12) (D4=7.0 μm) was prepared from the above ingredients otherwise in the same manner as in Example 1.

100 wt. parts of Toner 12 was externally blended with 0.8 wt. part of positively chargeable colloidal silica A to form positively chargeable Magnetic toner 12, which was evaluated in the same manner as in Example 1.

Example 13

| | |
|---|---|
| Binder resin 13 | 100 wt. part(s) |
| Triiron tetroxide 1 | 90 " |
| Triphenylmethane lake pigment | 2 " |
| Acetylacetone iron complex | 0.7 " |
| Polyethylene wax 1 | 3 " |
| Polyethylene wax 3 | 3 " |

Black fine powder (Toner 13) (D4=6.9 μm) was prepared from the above ingredients otherwise in the same manner as in Example 1.

100 wt. parts of Toner 13 was externally blended with 0.8 wt. part of positively chargeable colloidal silica A to form positively chargeable Magnetic toner 13, which was evaluated in the same manner as in Example 1.

Example 14

| | |
|---|---|
| Binder resin 14 | 100 wt. part(s) |
| Triiron tetroxide 1 | 90 " |
| Monoazo metal complex | 2 " |
| Salicylic acid aluminum complex | 0.5 " |
| Polyethylene wax 3 | 6 " |

Black fine powder (Toner 14) (D4=7.0 μm) was prepared from the above ingredients otherwise in the same manner as in Example 1.

100 wt. parts of Toner 14 was externally blended with 0.8 wt. part of negatively chargeable colloidal silica A to form negatively chargeable Magnetic toner 14, which was evaluated in the same manner as in Example 2.

Example 15

Black fine powder (Toner 15) (D4=7.1 μm) was prepared in the same manner as in Example 1 except for using a kneading machine having a paddle organization as shown in FIG. 16 having kneading sections provided with increased numbers of reverse feed paddles (L) and non-feed paddles (W) while setting the entire cylinder temperature to 170° C.

100 wt. parts of Toner 16 was externally blended with 0.8 wt. part of positively chargeable colloidal silica A to form positively chargeable Magnetic toner 16, which was evaluated in the same manner as in Example 1.

Example 16

Black fine powder (Toner 16) (D4=7.0 μm) was prepared in the same manner as in Example 1 except for using Fischer Tropsche wax 6 (Tmp=105° C., V (160° C.)=11 mpa.s) instead of Polyethylene wax 1 used in Example 1.

100 wt. parts of Toner 16 was externally blended with 0.8 wt. part of positively chargeable colloidal silica A to form positively chargeable Magnetic toner 16, which was evaluated in the same manner as in Example 1.

Example 17

Black fine powder (Toner 17) (D4=7.1 μm) was prepared in the same manner as in Example 1 except for using Triiron tetroxide 2 (Dn=0.18 μm, Hc=11.5 kA/m, $\sigma_s$=8.25 $Am^2$.kg, $\sigma_r$=12.1 $Am^2$/kg) instead of Triiron tetroxide 1 used in Example 1.

100 wt. parts of Toner 17 was externally blended with 0.8 wt. part of positively chargeable colloidal silica A to form positively chargeable Magnetic toner 17, which was evaluated in the same manner as in Example 1.

Example 18

Positively chargeable Magnetic toner 18 was prepared in the same manner as in Example 1 except that 100 wt. parts of Toner 1 was externally blended with 0.8 wt. part of positively chargeable silica fine powder B ($S_{BET}$=125 $m^2$/g) instead of positively chargeable silica fine powder A used in Example 1. Magnetic toner 18 was evaluated in the same manner as in Example 1.

Comparative Example 1

| | |
|---|---|
| Binder resin 15 | 100 wt. part(s) |
| Triiron tetroxide 1 | 90 " |
| Triphenylmethane lake pigment | 2 " |
| Polyethylene wax 1 | 6 " |

Black fine powder (Toner 19) (D4=6.8 μm) was prepared from the above ingredients otherwise in the same manner as in Example 1.

100 wt. parts of Toner 19 was externally blended with 0.8 wt. part of positively chargeable colloidal silica A to form positively chargeable Magnetic toner 19, which was evaluated in the same manner as in Example 1. Magnetic toner 19 exhibited inferior anti-low temperature offset property and anti-high temperature offset property than Magnetic toner 1 of Example 1. Further, Magnetic toner 19 resulted in the winding of fixation sheet about the fixing roller. The results of evaluation are inclusively shown in Table 1 together with those of Examples described above and Comparative Examples described below.

Comparative Example 2

| | |
|---|---|
| Binder resin 16 | 100 wt. part(s) |
| Triiron tetroxide 1 | 90 " |
| Monoazo iron complex | 2 " |
| Salicylic acid aluminum complex | 1.0 " |
| Polyethylene wax 1 | 6 " |

Black fine powder (Toner 20) (D4=7.1 μm) was prepared from the above ingredients otherwise in the same manner as in Example 2.

100 wt. parts of Toner 20 was externally blended with 0.8 wt. part of negatively chargeable colloidal silica B to form negatively chargeable Magnetic toner 20, which was evaluated in the same manner as in Example 2. Magnetic toner 20 exhibited inferior low-temperature fixability than Magnetic toner 2 of Example 2, further caused the winding of the fixation sheet about the fixing roller, resulted in traces of separation claws in the fixed images and also caused white image dropout attributable to the soiling of the fixing roller.

Comparative Example 3

| | |
|---|---|
| Binder resin 17 | 100 wt. part(s) |
| Triiron tetroxide 1 | 90 " |
| Triphenylmethane lake pigment | 2 " |
| Acetylacetone iron complex | 0.3 " |
| Polyethylene wax 1 | 6 " |

Black fine powder (Toner 21) (D4=6.8 μm) was prepared from the above ingredients otherwise in the same manner as in Example 1.

100 wt. parts of Toner 21 was externally blended with 0.8 wt. part of positively chargeable colloidal silica A to form positively chargeable Magnetic toner 21, which was evaluated in the same manner as in Example 1. Magnetic toner caused the winding of the fixation sheet about the fixing roller and traces of separation claws on the fixed images, and also exhibited inferior anti-blocking property.

Comparative Example 4

| | |
|---|---|
| Binder resin 18 | 100 wt. part(s) |
| Triiron tetroxide 1 | 90 " |
| Triphenylmethane lake pigment | 2 " |
| Polyethylene wax 1 | 6 " |

Black fine powder (Toner 22) (D4=7.1 μm) was prepared from the above ingredients otherwise in the same manner as in Example 1.

100 wt. parts of Toner 22 was externally blended with 0.8 wt. part of positively chargeable colloidal silica A to form positively chargeable Magnetic toner 22, which was evaluated in the same manner as in Example 1. Magnetic toner 22 exhibited inferior low-temperature fixability than Magnetic toner 1 of Example 1, and further resulted in white image dropout attributable to soiling of the fixing roller and winding of the fixation sheet about the fixing roller.

Comparative Example 5

| | |
|---|---|
| Binder resin 19 | 100 wt. part(s) |
| Triiron tetroxide 1 | 90 " |
| Triphenylmethane lake pigment | 2 " |
| Salicylic acid aluminum complex | 0.5 " |
| Polyethylene wax 1 | 6 " |

Black fine powder (Toner 23) (D4=6.9 μm) was prepared from the above ingredients otherwise in the same manner as in Example 1.

100 wt. parts of Toner 23 was externally blended with 0.8 wt. part of positively chargeable colloidal silica A to form positively chargeable Magnetic toner 23, which was evaluated in the same manner as in Example 1. Magnetic toner 23 resulted in winding of the fixation sheet about the fixing roller and also exhibit inferior anti-blocking property.

Comparative Example 6

| | |
|---|---|
| Binder resin 20 | 100 wt. part(s) |
| Triiron tetroxide 1 | 90 " |
| Monoazo iron complex | 2 " |
| Acetylacetone iron complex | 1 " |
| Polypropylene wax 4 | 6 " |

Black fine powder (Toner 24) (D4=7.2 μm) was prepared from the above ingredients otherwise in the same manner as in Example 2.

100 wt. parts of Toner 24 was externally blended with 0.8 wt. part of negatively chargeable colloidal silica B to form negatively chargeable Magnetic toner 24, which was evaluated in the same manner as in Example 2. Magnetic toner 24 exhibited an inferior low-temperature fixability than Magnetic toner 2 of Example 2.

Comparative Example 7

| | |
|---|---|
| Binder resin 21 | 100 wt. part(s) |
| Triiron tetroxide 1 | 90 " |
| Triphenylmethane lake pigment | 2 " |
| Acetylacetone iron complex | 1 " |
| Polyethylene wax 1 | 6 " |

Black fine powder (Toner 25) (D4=6.9 μm) was prepared from the above ingredients otherwise in the same manner as in Example 1.

100 wt. parts of Toner 25 was externally blended with 0.8 wt. part of positively chargeable colloidal silica A to form positively chargeable Magnetic toner 25, which was evaluated in the same manner as in Example 1. Magnetic toner 25 exhibited inferior low-temperature fixability, anti-high-temperature offset property and fog-suppression performances at the initial stage and on 50,000-th sheet than Magnetic toner 1 of Example 1. Magnetic toner 25 also resulted in toner melt-sticking onto the photosensitive member and white image dropout attributable to soiling of the fixing roller.

Comparative Example 8

| | |
|---|---|
| Binder resin 22 | 100 wt. part(s) |
| Triiron tetroxide 1 | 90 " |
| Monoazo iron complex | 2 " |
| Polyethylene wax 1 | 6 " |

Black fine powder (Toner 26) (D4=7.0 μm) was prepared from the above ingredients otherwise in the same manner as in Example 2.

100 wt. parts of Toner 26 was externally blended with 0.8 wt. part of negatively chargeable colloidal silica B to form negatively chargeable Magnetic toner 26, which was evaluated in the same manner as in Example 2. Magnetic toner 26 exhibited inferior anti-high-temperature offset property and fog-suppression performances at the initial stage and on 50,000 sheet than Magnetic toner 2 of Example 2.

Comparative Example 9

| | |
|---|---|
| Binder resin 23 | 100 wt. part(s) |
| Triiron tetroxide 1 | 90 " |
| Salicylic acid chromium complex | 2 " |
| Polypropylene wax 4 | 6 " |

Black fine powder (Toner 27) (D4=7.2 μm) was prepared in the same manner as in Example 1 except for kneading the above ingredients in the same twin-screw extruder as used in Example 1 while setting the entire cylinder temperature at 110° C.

100 wt. parts of Toner 27 was externally blended with 0.8 wt. part of negatively chargeable colloidal silica B to form positively chargeable Magnetic toner 27, which was evaluated in the same manner as in Example 2.

As a result, Magnetic toner 27 resulted in inferior performances regarding suppression of separation claw traces and winding of fixation about the fixing roller.

TABLE 1

| Toner properties | | | | | | | | | | | | | | | | |
|---|---|---|---|---|---|---|---|---|---|---|---|---|---|---|---|---|
| | Visco-elasticities | | | | | | | | | | | | | | | |
| | 160° C. | | | 190° C. | | | G' 160/190) | Min. of tan δ (80–200° C.) | GPC Peak M.W. main peak | sub-peak | Areal percentage (%) in M.W. ranges (× $10^4$) 10–20 | 20–50 | 50–100 | >100 | THF ins. (wt %) | D4 (μm) |
| Toner | G' (Pa) | G' (Pa) | tan δ | G' (Pa) | G' (Pa) | tan δ | | | | | | | | | | |
| 1 | 3700 | 1700 | 0.48 | 4000 | 830 | 0.21 | 0.93 | no | 14000 | 1100 | 3.1 | 4.0 | 2.0 | 1.1 | 25 | 7.0 |
| 2 | 4900 | 2200 | 0.45 | 4800 | 1500 | 0.31 | 1.02 | no | 16000 | — | 2.7 | 3.3 | 2.2 | 3.2 | 18.1 | 7.2 |
| 3 | 3500 | 2500 | 0.71 | 3300 | 1300 | 0.39 | 1.06 | no | 12000 | 2100 | 4.1 | 4.3 | 3.7 | 4.7 | 20.3 | 6.8 |
| 4 | 2200 | 680 | 0.31 | 1900 | 570 | 0.30 | 1.16 | yes | 10000 | 1200 | 3.6 | 2.7 | 0.8 | 0.5 | 8 | 6.9 |
| 5 | 5200 | 2300 | 0.44 | 4900 | 390 | 0.08 | 1.06 | no | 18000 | 1100 | 1.8 | 2.0 | 4.3 | 5.5 | 37 | 7.0 |
| 6 | 1800 | 1600 | 0.89 | 1000 | 820 | 0.41 | 1.80 | no | 5000 | — | 1.2 | 1.4 | 1.8 | 3.1 | 10.5 | 6.8 |
| 7 | 6100 | 1500 | 0.25 | 5900 | 1200 | 0.20 | 1.03 | no | 32000 | 1100 | 2.5 | 2.1 | 2.3 | 3.2 | 26.8 | 7.1 |
| 8 | 3100 | 1100 | 0.35 | 1700 | 400 | 0.24 | 1.82 | no | 8000 | 1000 | 3.0 | 3.7 | 4.0 | 2.6 | 31.5 | 7.0 |
| 9 | 900 | 680 | 0.76 | 720 | 530 | 0.74 | 1.25 | no | 6000 | 2300 | 4.0 | 4.5 | 3.8 | 4.8 | 26.3 | 6.9 |
| 10 | 1100 | 2700 | 0.25 | 8900 | 1800 | 0.20 | 1.24 | no | 24000 | 800 | 1.9 | 1.6 | 1.0 | 1.3 | 19.2 | 7.2 |
| 11 | 1200 | 450 | 0.38 | 970 | 240 | 0.25 | 1.24 | yes | 7000 | — | 2.2 | 1.7 | 1.8 | 0.8 | 15.3 | 7.1 |
| 12 | 6500 | 5600 | 0.86 | 6000 | 3700 | 0.62 | 1.08 | no | 20000 | 1200 | 3.3 | 2.9 | 3.1 | 1.9 | 27 | 7.0 |

TABLE 1-continued

| | Toner properties | | | | | | | | | | | | | | | |
|---|---|---|---|---|---|---|---|---|---|---|---|---|---|---|---|---|
| | Visco-elasticities | | | | | | | | GPC | | | | | | | |
| | 160° C. | | | 190° C. | | | G' | tan δ | Peak M.W. | | Areal percentage (%) | | | | THF | |
| | G' | G' | | G' | G' | | 160/ | (80– | main | sub- | in M.W. ranges (× $10^4$) | | | | ins. | D4 |
| Toner | (Pa) | (Pa) | tan δ | (Pa) | (Pa) | tan δ | 190) | 200° C.) | peak | peak | 10–20 | 20–50 | 50–100 | >100 | (wt %) | (μm) |
| 13 | 3800 | 840 | 0.22 | 7200 | 360 | 0.05 | 0.53 | no | 15000 | 1600 | 3.7 | 3.0 | 3.2 | 3.6 | 31 | 6.9 |
| 14 | 1300 | 1800 | 1.38 | 1100 | 1200 | 1.09 | 1.18 | no | 9000 | 2200 | 2.2 | 2.3 | 2.6 | 4.7 | 23.2 | 7.0 |
| 15 | 3900 | 1800 | 0.46 | 4100 | 840 | 0.21 | 0.95 | no | 14000 | 1100 | 2.7 | 3.5 | 2.1 | 1.6 | 27.5 | 7.1 |
| 16 | 3800 | 1900 | 0.50 | 4000 | 920 | 0.23 | 0.95 | no | 14000 | — | 3.0 | 4.1 | 1.9 | 1.2 | 25.2 | 7.0 |
| 17 | 3600 | 1700 | 0.47 | 3900 | 820 | 0.22 | 0.92 | no | 14000 | 1100 | 3.1 | 3.9 | 2.0 | 1.0 | 24.8 | 7.1 |
| 18 | 3700 | 1700 | 0.48 | 4000 | 830 | 0.21 | 0.93 | no | 14000 | 1100 | 3.1 | 4.0 | 2.0 | 1.1 | 25 | 7.0 |
| 19 | 720 | 700 | 0.97 | 550 | 440 | 0.80 | 1.31 | no | 8000 | 900 | 3.2 | 3.6 | 1.8 | 2.3 | 0.2 | 7.0 |
| 20 | 13000 | 240 | 0.02 | 5200 | 1400 | 0.27 | 2.50 | no | 22000 | 2200 | 2.2 | 1.8 | 3.6 | 2.2 | 23.6 | 7.1 |
| 21 | 1200 | 370 | 0.31 | 930 | 180 | 0.19 | 1.29 | yes | 2700 | 1100 | 3.1 | 4.0 | 2.2 | 3.6 | 35.3 | 6.8 |
| 22 | 7700 | 6400 | 0.83 | 5000 | 4300 | 0.86 | 1.54 | no | 31000 | 1800 | 4.3 | 3.9 | 3.1 | 8.2 | 0.1 | 7.1 |
| 23 | 4000 | 2100 | 0.53 | 2200 | 190 | 0.09 | 1.82 | no | 2800 | 800 | 1.5 | 1.5 | 1.1 | 2.1 | 12.3 | 6.9 |
| 24 | 7000 | 6500 | 0.93 | 12000 | 1100 | 0.09 | 0.58 | no | 45000 | — | 3.7 | 3.6 | 4.0 | 3.7 | 37.6 | 7.2 |
| 25 | 4600 | 2800 | 0.61 | 2600 | 1800 | 0.69 | 1.77 | no | 15000 | 2500 | 4.2 | 2.7 | 5.4 | 7.3 | 47 | 6.9 |
| 26 | 750 | 730 | 0.97 | 1400 | 1000 | 0.71 | 0.54 | no | 6000 | 1700 | 0.7 | 0.8 | 1.6 | 1.2 | 0 | 7.0 |
| 27 | 4500 | 4900 | 1.09 | 2100 | 1700 | 0.81 | 2.14 | yes | 19000 | — | 6.4 | 5.9 | 4.0 | 21.5 | 27.3 | 7.2 |

TABLE 2

| | Performance evaluation results | | | | | | | | | |
|---|---|---|---|---|---|---|---|---|---|---|
| | Fixing performance | | | Image fog (%) | | | Separa- | Soiling | | |
| | | | | | on | Winding | tion | of | | |
| Ex. or Comp. Ex. | $T_{F.I.}$ (°C.) | $T_{offset.min}$ (°C.) | $T_{offset.max}$ (°C.) | initial | 50000-th sheet | about roller | craw trace | fixing roller | Melt-sticking | Anti-block |
| Ex. 1 | 140 | 135 | >250 | 0.7 | 0.8 | A | A | A | A | A |
| Ex. 2 | 150 | 140 | >250 | 0.8 | 0.9 | A | A | A | A | A |
| Ex. 3 | 145 | 135 | 245 | 1.7 | 1.8 | A | A | A | A | A |
| Ex. 4 | 140 | 135 | 240 | 1.4 | 1.6 | B | B | C | A | A |
| Ex. 5 | 155 | 145 | 245 | 1.3 | 1.4 | A | A | A | C | A |
| Ex. 6 | 150 | 140 | 245 | 1.4 | 1.5 | A | A | A | A | C |
| Ex. 7 | 155 | 145 | >250 | 1 | 1.2 | A | A | A | A | A |
| Ex. 8 | 140 | 135 | >250 | 0.9 | 1 | A | A | A | B | B |
| Ex. 9 | 145 | 150 | 240 | 1.8 | 2 | B | B | A | A | B |
| Ex. 10 | 155 | 145 | 245 | 1.5 | 1.7 | A | A | A | A | B |
| Ex. 11 | 150 | 140 | 240 | 0.8 | 1 | B | C | C | A | B |
| Ex. 12 | 155 | 145 | >250 | 0.9 | 1 | A | A | A | A | A |
| Ex. 13 | 155 | 145 | >250 | 0.8 | 1 | B | B | A | B | A |
| Ex. 14 | 140 | 135 | 240 | 1 | 1.2 | A | A | A | C | B |
| Ex. 15 | 140 | 135 | >250 | 0.9 | 0.9 | A | A | A | A | A |
| Ex. 16 | 145 | 140 | >250 | 0.3 | 0.4 | A | A | A | A | A |
| Ex. 17 | 140 | 135 | >250 | 0.5 | 0.6 | A | A | A | A | A |
| Ex. 18 | 140 | 135 | >250 | 0.9 | 0.8 | A | A | A | A | A |
| Comp. Ex. 1 | 150 | 160 | 220 | 0.8 | 0.9 | C | B | A | A | C |
| Ex. 2 | 170 | 155 | >250 | 1 | 1.2 | D | D | D | A | A |
| Ex. 3 | 140 | 135 | >250 | 1.1 | 1.3 | D | D | C | C | D |
| Ex. 4 | 180 | 165 | 245 | 1.3 | 1.5 | C | A | D | A | A |
| Ex. 5 | 150 | 140 | 245 | 1.4 | 1.6 | C | A | A | A | D |
| Ex. 6 | 190 | 175 | 245 | 1.1 | 1.4 | B | A | A | C | A |
| Ex. 7 | 170 | 160 | 225 | 2.6 | 2.9 | B | A | D | D | A |
| Ex. 8 | 150 | 160 | 215 | 2.8 | 3.2 | C | B | A | A | B |
| Ex. 9 | 155 | 150 | 245 | 1.2 | 1.1 | C | D | A | B | A |

What is claimed is:

1. A toner comprising: at least a binder resin, a wax and a colorant, wherein the toner exhibits visco-elastic properties including:

(a) a storage modulus G' (160° C.) of $8.0\times10^2$–$1.2\times10^4$ Pa at 160° C., (b) a loss modulus G" (160° C.) of $4.0\times10^2$–$6.0\times10^3$ Pa at 160° C., (c) a loss tangent tanδ (160° C.)=G" (160° C./G' (160° C.) of 0.1–1.5 at 160° C., (d) a storage modulus G' (190° C.) of $6.0\times10^2$–$1.0\times10^4$ Pa at 190° C., (e) a loss modulus G" (190° C.) of $2.0\times10^2$–$4.0\times10^3$ Pa at 190° C., (f) a loss tangent tanδ (190° C.)=G" (190° C.)/G' (190° C.) of 0.05–1.2 at 190° C., (g) G' (160° C.)/G' (190° C.)=0.5–2.0, and (h) tanδ (160° C.)>tanδ (190° C.).

2. The toner according to claim 1, having (a) a storage modulus G' (160° C.) of $1.0\times10^3$–$1.0\times10^4$ Pa at 160° C., (b) a loss modulus G" (160° C.) of $5.0\times10^2$–$5.0\times10^3$ Pa at 160° C., and (c) a loss tangent tanδ (160° C.)=G" (160° C.)/G' (160° C.) of 0.1–1.0 at 160° C.

3. The toner according to claim 1, having (d) a storage modulus G' (190° C.) of $8.0\times10^2$–$8.0\times10^3$ Pa at 190° C., (e) a loss modulus G" (190° C.) of $3.0\times10^2$–$3.0\times10^3$ Pa at 190° C., and (f) a loss tangent tanδ (190° C.)=G" (190° C.)/G' (190° C.) of 0.06–1.0 at 190° C.

4. The toner according to claim 1, having (i) no minimum of tanδ in the temperature range of 80–200° C.

5. The toner according to claim 1, having (a) a storage modulus G' (160° C.) of $1.0\times10^3$–$1.0\times10^4$ Pa at 160° C., (b) a loss modulus G" (160° C.) of $5.0\times10^2$–$5.0\times10^3$ Pa at 160° C., (c) a loss tangent tanδ (160° C.)=G" (160° C.)/G' (160° C.) of 0.1–1.0 at 160° C., (d) a storage modulus G' (190° C.) of $8.0\times10^2$–$8.0\times10^3$ Pa at 190° C., (e) a loss modulus G" (190° C.) of $3.0\times10^2$–$3.0\times10^3$ Pa at 190° C., (f) a loss tangent tanδ (190° C.)=G" (190° C.)/G' (190° C.) of 0.06–1.0 at 190° C., and (i) no minimum of tanδ in the temperature range of 80–200° C.

6. The toner according to claim 1, having (g) a ratio G' (160° C.)/G' (190° C.) of 0.6–1.8.

7. The toner according to claim 1, having (g) a ratio G' (160° C.)/G' (190° C.) of 0.7–1.5.

8. The toner according to claim 1, containing a THF-soluble content which has such a molecular weight distribution based on a GPC chromatogram as to provide a main peak in a molecular weight region of $3\times10^3$–$4\times10^4$ and contain 1.0–5.0% (by area on the chromatogram) of components in a molecular weight range of $1\times10^5$–$2\times10^5$, 1.0–5.0% of components in a molecular weight range of $2\times10^5$–$5\times10^5$, 0.5–5.0% of components in a molecular weight range of $5\times10^5$–$1\times10^6$, and 0.2–6.0% of components in a molecular weight range of $1\times10^6$ or larger.

9. The toner according to claim 1, wherein the binder and the wax contain a THF-insoluble content of 1–50 wt. %.

10. The toner according to claim 1, having such a molecular weight distribution based on a GPC chromatogram as to provide a main peak in a molecular weight region of $3\times10^3$–$4\times10^4$ and contain 1.0–5.0% (by area on the chromatogram) of components in a molecular weight range of $1\times10^5$–$2\times10^5$, 1.0–5.0% of components in a molecular weight range of $2\times10^5$–$5\times10^5$, 0.5–5.0% of components in a molecular weight range of $5\times10^5$–$1\times10^6$, and 0.2–6.0% of components in a molecular weight range of $1\times10^6$ or larger, and the toner containing 1–50 wt. % of the binder and the wax as a THF-insoluble content.

11. The toner according to claim 1, wherein the binder resin includes at least one type of crosslinkage formed through crosslinking reactions selected from the group consisting of:

copolymerization using a polyfunctional vinyl monomer having two or more vinyl groups; polycondensation using monomers, at least one of which is polyfunctional; crosslinking between functional groups of polymer molecules having a functional group via a reactive compound capable of reacting with the functional group; reaction between a first polymer having a functional group and a second polymer having a functional group reactive with the functional group of the first polymer; crosslinking by polycondensation of addition polymer(s); and crosslinking by addition polymerization of condensation polymer(s).

12. The toner according to claim 1, wherein the binder resin includes a first type of crosslinkage formed during production of the binder resin, and a second type of crosslinkage formed during melt-kneading of the binder resin with other toner ingredients for toner production.

13. The toner according to claim 1, wherein the binder resin includes a first type of crosslinkage formed during production of the binder resin, and a during melt-kneading of the binder resin with other toner ingredients for toner production, and a second type of crosslinkage formed during the melt-kneading of the binder resin with other toner ingredients for toner production.

14. The toner according to claim 1, wherein the binder resin has at least two types of crosslinkages formed by subjecting a resin having a first type of crosslinkage through a first crosslinking reaction to a second crosslinking reaction.

15. The toner according to claim 1, wherein the binder resin has been obtained through a first crosslinking by reacting a resin having an acid group with a reactive compound or polymer, and then a second crosslinking to provide a crosslinkage via a second reactive compound or polymer.

16. The toner according to claim 1, wherein the binder resin includes a first type of crosslinkage formed by a first crosslinking reaction and a second type of crosslinkage formed by a second crosslinking reaction;

wherein the first crosslinking reaction is selected from the group consisting of copolymerization using a polyfunctional vinyl monomer; polycondensation using monomers, at least one of which is polyfunctional; crosslinking between functional groups of polymer molecules having such a functional group via a reactive compound capable of reacting with the reactive group; reaction between a first polymer having a functional group and a second polymer having a functional group reactive with the functional group of the first polymer; graft reaction using a polymerization initiator; crosslinking by polycondensation of addition polymer (s); and crosslinking by addition polymerization of condensation polymer(s); and the second crosslinking reaction is selected from the group consisting of crosslinking between functional groups of polymer molecules having such a functional group via a reactive compound capable of reacting with the reactive group; and reaction between a first polymer having a functional group and a second polymer having a functional group reactive with the functional group of the first polymer.

17. The toner according to claim 1, wherein the binder resin includes a first type of crosslinkage formed by a first crosslinking reaction, and a second type of crosslinkage formed by a second crosslinking reaction, wherein the first crosslinking reaction is selected from the group consisting of crosslinking between functional groups of polymer molecules having such a functional group via a reactive compound capable of reacting with the reactive group; and reaction between a first polymer having a functional group and a second polymer having a functional group reactive with the functional group of the first polymer; and the second crosslinking reaction is crosslinking between functional groups of polymer molecules having such a functional group via a reactive compound capable of reacting with the reactive group.

18. The toner according to claim 17, wherein the second crosslinking is effected during melt-kneading of a precursor resin of the binder resin and other toner ingredients for toner production.

19. The toner according to claim 1, wherein the binder resin includes polymer chains having functional groups which are bonded via an ester bond, an amide bond, an imide bond or a carbon-to-carbon bond to form a crosslinkage.

20. The toner according to claim 1, wherein the binder resin includes polymer chains having functional groups which are bonded via a compound selected from the group consisting of acids, alcohols, amines, imines, epoxides, acid anhydrides, ketones, aldehydes, amides, esters, lactones and lactams to form a crosslinkage.

21. The toner according to claim 1, wherein the binder includes polymer chains having acid groups which are bonded via a compound selected from the group consisting of glycidyl compounds, amine compounds, imine compounds, epoxy compounds, carboxylic acid compounds, alcohol compounds, metal salts, metal complexes, and organometallic compounds to form a crosslinkage.

22. The toner according to claim 21, wherein the binder resin include polymer chains having acid groups bonded via a glycidyl compound and has been formed by reaction between (i) a glycidyl group-containing copolymer including glycidyl group-containing vinyl monomer units and styrene monomer units, and (ii) an acid group-containing copolymer including acid group-containing vinyl monomer units and styrene monomer units.

23. The toner according to claim 22, wherein the glycidyl group-containing copolymer has a weight-average molecular weight of $4\times10^3$–$10^5$.

24. The toner according to claim 22, wherein said glycidyl group-containing monomer is selected from the group consisting of glycidyl acrylate, glycidyl methacrylate, β-methylglycidyl acrylate, β-methylglycidyl methacrylate, allyl glycidyl ether, and allyl β-methlglycidyl ether.

25. The toner according to claim 21, wherein said glycidyl compound is used in 0.05–10 equivalents per mol of the acid groups.

26. The toner according to claim 21, wherein said metal salt or metal complex includes a mono-valent metal ion selected from the group consisting of $Na^+$, $Li^+$, $K^+$, $Cs^+$, $Ag^+$, $Hg^+$ and $Cu^+$.

27. The toner according to claim 21, wherein said metal salt or metal complex includes a divalent metal ion selected from the group consisting of $Be^{2+}$, $Ba^{2+}$, $Ca^{2+}$, $Hg^{2+}$, $Sn^{2+}$, $Pb^{2+}$, $Mn^{2+}$, $Fe^{2+}$, $Ca^{2+}$, $Ni^{2+}$ and $Zn^{2+}$.

28. The toner according to claim 21, wherein said metal salt or metal complex includes a trivalent metal ion selected from the group consisting of $Al^{3+}$, $Sc^{3+}$, $Fe^{3+}$, $V^{3+}$, $Co^{3+}$, $Ce^{3+}$, $Ni^{3+}$, $Cr^{3+}$ and $Y^{3+}$.

29. The toner according to claim 21, wherein said metal salt or metal complex includes a tetravalent metal ion of $Ti^{4+}$ or $Zr^{4+}$.

30. The toner according to claim 1, wherein the binder resin includes a crosslinkage formed by a crosslinking vinyl monomer having two or more polymerizable double bonds.

31. The toner according to claim 30, wherein said crosslinking vinyl monomer has been used in 0.01–5.0 wt. parts per 100 wt. parts of other vinyl monomers.

32. The toner according to claim 1, wherein the wax has such a molecular weight distribution as to provide a number-average molecular weight (Mn) of 200–1200, a weight-average molecular weight (Mw) of 300– 3600, and a ratio Mw/Mn of at most 3.

33. The toner according to claim 1, wherein the wax has such a molecular weight distribution as to provide a number-average molecular weight (Mn) of 250–1000, a weight-average molecular weight (Mw) of 350–3000, and a ratio Mw/Mn of at most 2.5.

34. The toner according to claim 1, wherein the wax has a melting point of 70–155° C.

35. The toner according to claim 1, wherein the wax has a melting point of 75–140° C.

36. The toner according to claim 1, wherein the wax has a melt-viscosity at 160° C. of at most 500 mPa.s.

37. The toner according to claim 1, wherein the wax has a melt-viscosity at 140° C. of at most 500 mPa.s.

38. The toner according to claim 1, wherein the wax is contained in 0.1–15 wt. parts per 100 wt. parts of the binder resin.

39. The toner according to claim 1, wherein the wax is contained in 0.5–12 wt. parts per 100 wt. parts of the binder resin.

40. The toner according to claim 1, which is a magnetic toner containing a magnetic material as the colorant.

41. The toner according to claim 40, wherein the magnetic material comprise magnetic particles having a number-average particle size of at most 2 μm.

42. The toner according to claim 40, wherein the magnetic material has magnetic particles as measured by application of $7.96\times10^2$ kA/m including a coercive force (Hc) of 1.6–23.9 kA/m, a saturation magnetization ($\sigma_s$) of 50–200 $Am^2/kg$, and a residual magnetization ($\sigma_r$) of 2–20 $Am^2/kg$.

43. The toner according to claim 40, wherein the magnetic toner contains 20–200 wt. parts of the magnetic material per 100 wt. parts of the binder resin.

44. The toner according to claim 1, having a weight-average particle size (D4) of 4–10 μm.

45. The toner according to claim 1, containing silica fine powder externally blended therewith.

46. An image forming method, comprising:

(1) a developing step of developing an electrostatic latent image on an image bearing member with a toner to form a toner image thereon, (2) a transfer step of transferring the toner image formed on the image bearing member onto a recording material via or without via an intermediate transfer member, and (3) a fixing step of heat-fixing the toner image transferred to the recording material onto the recording material, wherein the toner comprises at least a binder resin, a wax and a colorant, and the toner exhibits visco-elastic properties including:

(a) a storage modulus G' (160° C.) of $8.0\times10^2$–$1.2\times10^4$ Pa at 160° C., (b) a loss modulus G" (160° C.) of $4.0\times10^2$–$6.0\times10^3$ Pa at 160° C., (c) a loss tangent tanδ (160° C.)=G" (160° C.)/G' (160° C.) of 0.1–1.5 at 160° C., (d) a storage modulus G' (190° C.) of $6.0\times10^2$–$1.6\times10^4$ Pa at 190° C., (e) a loss modulus G" (190° C.) of $2.0\times10^2$–$4.0\times10^3$ Pa at 190° C., (f) a loss tangent tanδ (190° C.)=G" (190° C.)/G' (190° C.) of 0.05–1.2 at 190° C., (g) G' (160° C.)/G' (190° C.)=0.5–2.0, and (h) tanδ (160° C.)>tanδ (190° C.).

47. The method according to claim 46, wherein in the developing step, the electrostatic latent image held on the image bearing member is developed with a layer of a mono-component developer comprising the toner carried in a thickness regulated by a developer layer thickness regulation means on a developer-carrying member disposed opposite to the image-bearing member.

48. The method according to claim 47, wherein the monocomponent developer layer on the developer-carrying member is formed in a thickness that is smaller than a minimum gap between surfaces of the image-bearing member and the developer-carrying member at a developing region.

49. The method according to claim 48, wherein in the developing step, the electrostatic image is developed under application of a bias voltage to the developer-carrying member.

50. The method according to claim 49, wherein the bias voltage comprises an alternating voltage superposed with a direct current voltage.

51. The method according to claim 46, wherein the image-bearing member comprises an electrophotographic photosensitive member.

52. The method according to claim 51, wherein the image-bearing member comprises a photoconductor selected from the group consisting of amorphous silicon, organic photoconductor and selenium.

53. The method according to claim 46, wherein the image bearing member comprises a photoconductor selected from amorphous silicon and organic photoconductor.

54. The method according to claim 46, operated at a process speed of at least 200 mm/sec.

55. The method according to claim 46, wherein the toner is a toner according to any of claims 2–45.

* * * * *

UNITED STATES PATENT AND TRADEMARK OFFICE

CERTIFICATE OF CORRECTION

PATENT NO. : 5,968,701

DATED : October 19, 1999

INVENTOR(S) : TSUTOMU ONUMA ET AL.

It is certified that error appears in the above-identified patent and that said Letters Patent is hereby corrected as shown below:

ON THE TITLE PAGE:

[30] under Foreign Application Priority Data,

"356562" should read --9-356562--.

[57] in the ABSTRACT,

Line 9, "$1.6x10^4$" should read --$1.0x10^4$--.

COLUMN 1:

Line 32, "tends" should read --tend--.

COLUMN 5:

Line 50, "and (f)" should read --and ¶(f)--.

COLUMN 12:

Line 33, "ia a" should read --via a--.

COLUMN 14:

Line 44, "or/and" should read --and/or--.

COLUMN 17:

Line 65, "than" should read --to--.

UNITED STATES PATENT AND TRADEMARK OFFICE

CERTIFICATE OF CORRECTION

PATENT NO. : 5,968,701

DATED : October 19, 1999

INVENTOR(S) : TSUTOMU ONUMA ET AL.

It is certified that error appears in the above-identified patent and that said Letters Patent is hereby corrected as shown below:

COLUMN 18:

Line 66, "or/and" should read --and/or--.

COLUMN 19:

Line 63, "thousands" should read--thousand--.

COLUMN 24:

Line 44, "illustraed" should read--illlustrated--.

COLUMN 26:

Line 42, "material A partion" should read --material P. ¶A partion--.

COLUMN 35:

Line 34, "was" should read --were--.

COLUMN 37:

Line 44, "($S_{BET}$=160 m/g)" should read --($S_{BET}$=160 $m^2$/g)--.

COLUMN 37:

Line 52, "and" should be deleted.

UNITED STATES PATENT AND TRADEMARK OFFICE

CERTIFICATE OF CORRECTION

PATENT NO. : 5,968,701

DATED : October 19, 1999

INVENTOR(S) : TSUTOMU ONUMA ET AL.

It is certified that error appears in the above-identified patent and that said Letters Patent is hereby corrected as shown below:

COLUMN 44:

Line 20, "50,000" should read --50,000-th--.

COLUMN 49:

Line 46, "β-methlglycidyl" should read --β-methylglycidyl--; and

Line 56, "$Ba^{2+}$, $Ca^{2+}$," should read --$Ba^{2+}$, $Mg^{2+}$, $Ca^{2+}$,--.

Signed and Sealed this

Tenth Day of April, 2001

Nicholas P. Godici

*Attest:*

NICHOLAS P. GODICI

*Attesting Officer*

*Acting Director of the United States Patent and Trademark Office*